US005754919A

United States Patent [19]

Sugimoto et al.

[11] Patent Number: 5,754,919

[45] Date of Patent: May 19, 1998

[54] ELECTROSTATIC RECORDING APPARATUS UTILIZING SUPERIMPOSITION OF COLORS IN A TONER IMAGE TO RECORD A MULTICOLOR IMAGE

[75] Inventors: Katsumi Sugimoto; Yoshihiro Tonomoto; Keiko Tonai; Yoshinori Wada, all of Kawasaki, Japan

[73] Assignee: Fujitsu Limited, Kawasaki, Japan

[21] Appl. No.: 563,578

[22] Filed: Nov. 28, 1995

[30] Foreign Application Priority Data

Dec. 13, 1994 [JP] Japan ..... 6-308984

[51] Int. Cl.[6] ..... G03G 15/00

[52] U.S. Cl. ..... 399/49; 399/138

[58] Field of Search ..... 355/208, 203, 355/204, 214, 326, 327; 347/133; 399/49, 50, 51, 55, 138

[56] References Cited

U.S. PATENT DOCUMENTS

| | | | |
|---|---|---|---|
| 5,351,107 | 9/1994 | Nakane et al. | 355/208 |
| 5,400,120 | 3/1995 | Narazaki et al. | 355/208 |

FOREIGN PATENT DOCUMENTS

| | | |
|---|---|---|
| 58-100140 | 6/1983 | Japan . |
| 63-106763 | 5/1988 | Japan . |
| 4-77176 | 3/1992 | Japan . |
| 5-92642 | 4/1993 | Japan . |
| 5-153382 | 6/1993 | Japan . |

*Primary Examiner*—Arthur T. Grimley
*Assistant Examiner*—Quana Grainger
*Attorney, Agent, or Firm*—Armstrong, Westerman, Hattori, McLeland & Naughton

[57] ABSTRACT

A multicolor electrostatic recording apparatus in which two or more different color toner image are superimposed by respective electrostatic recording units. Each of the electrostatic recording units includes an electrostatic latent image carrier, a developer for developing an electrostatic latent image formed on the carrier with a color toner, and a detector for detecting the density of the developed image on the basis of a detecting mark which is formed on the carrier as a part of the latent image and developed by the developer. A discriminating means compares the density data with an optional desired density value to discriminate whether the density data falls in an allowable range. A controller feedback controls at least one of parameters for determining the density of the developed image so that the density becomes to be in the allowable range, when the density falls out of the allowable range. The parameter is memorized as a compensating data for the density of the developed image, when the density falls in the allowable range. Thus, with the compensating data, a process using the parameter for determining the density of the developed image is carried out.

10 Claims, 21 Drawing Sheets

ELECTROSTATIC RECORDING APPARATUS UTILIZING SUPERIMPOSITION OF COLORS IN A TONER IMAGE TO RECORD A MULTICOLOR IMAGE

BACKGROUND OF THE INVENTION

1. Field of the Invention

The present invention relates to a multicolor electrostatic recording apparatus in which toner images of at least two colors are superimposed so as to record a multicolor image.

2. Description of the Related Art

In general, the following processes are successively carried out in an electrostatic recording apparatus. In an electrostatic latent image writing process, an electrostatic latent image is written on an electrostatic latent image carrier such as a photoreceptor, a dielectric body or the like. In a development process, the electrostatic latent image is electrostatically developed with electrically charged toner so as to obtain a charged toner image. In a transfer process, the charged toner image is electrostatically transferred onto a recording medium such as a recording sheet. In a fixation process, the transferred toner image is fixed onto the recording sheet. The electrostatic latent image writing process, the development process and the transfer process are repeated at least twice in the case of recording a multicolor image by the above electrostatic recording apparatus. In each development process, an electrically charged toner image of each color is formed using toner of each color, and each toner image is transferred onto the same recording sheet in each transfer process so as to be superimposed. That is, the transferred images of at least two colors are superimposed on the recording sheet. After that, the recording sheet is sent to the fixation process, and the transferred toner images of different colors are simultaneously fixed onto the recording sheet. As is well known, in the case of full color recording, toners of four colors including yellow, cyan, magenta and black are used. In this case, the electrostatic latent image writing process, the development process and the transfer process are repeatedly carried out for each color.

Hue is a very important factor when the quality of multicolor recording is evaluated, however, it is difficult to stably maintain such an important factor as hue at a predetermined value at all times. The reason why it is difficult to stably maintain the hue at a predetermined value is described as follows. In order to maintain the hue at a constant value, it is necessary to regulate an amount of deposited toner (development density) on the electrostatic latent image carrier to be a predetermined value. However, the amount of deposited toner is affected by the amount of electrical charge of toner. Further the amount of charge of toner is greatly affected by the environmental temperature and humidity. Furthermore, the hue of an image formed by multicolor recording is greatly affected by the deterioration with time of parts that compose the multicolor electrostatic recording apparatus. For example, when a photoreceptor drum is used as the electrostatic latent image carrier and a semiconductor laser is used as the writing means for writing an electrostatic latent image on the photoreceptor drum, the characteristics of the photoreceptor drum and the semiconductor laser deteriorate with time. Therefore, an amount of deposited toner is changed due to the deterioration with time.

On the other hand, in the above-mentioned multicolor electrostatic recording apparatus, it has been necessary to select either one of two modes, i.e., a normal mode in which multicolor printing is carried out in at full color density; and an economical mode in which multicolor printing is carried out at low color density. For example, if it is required to carry out a trial of multicolor printing prior to the normal mode printing, an economical mode printing is preferable in order to reduce the color toner consumption. In this case, however, the hue in the economical mode printing must be maintained the same as that in the normal mode printing. In the multicolor electrostatic recording apparatus known in the prior art, however, there are no special means for maintaining hue at the same level in these two printing conditions. In addition, when it is required to carry out multicolor printing at an optional color density, a constant hue should always be maintained.

SUMMARY OF THE INVENTION

An object of the present invention is to provide a multicolor electrostatic recording apparatus in which at least two color toner images are superimposed on the recording medium and multicolor printing can always be carried out with a constant hue.

Another object of the present invention is to provide a multicolor electrostatic recording apparatus in which hue in an economical mode printing can be maintained the same as that in a normal mode printing.

According to a first aspect of the present invention, there is provided a multicolor electrostatic recording apparatus comprising at least two electrostatic recording units for forming at least two different colors, respectively, and means for superimposing the at least two color toner images obtained by said respective units, each of said electrostatic recording units comprising: an electrostatic latent image carrier; a developing means for developing an electrostatic latent image formed on said carrier with a color toner; a detecting means for detecting a density of the developed image on the basis of a detecting mark which is formed on said carrier as a part of the latent image and developed by said developing means; a first discriminating means for comparing said density data detected by said detecting means with a predetermined first value to discriminate whether said density data falls within a first allowable range; a first control means for feed-back controlling at least one of parameters for determining the density of the developed image so that said density becomes to be in said first allowable range, when said density falls out of said first allowable range; a first memory means for memorizing said at least one parameter as a first compensating data for the density of the developed image, when said density falls in said first allowable range; a second discriminating means for comparing said density data detected by said detecting means with a predetermined second value to discriminate whether said density falls in a second allowable range; a second control means for feed-back controlling said at least one parameter for determining the density of the developed image so that said density becomes to be in said second allowable range, when said density falls out of said second allowable range; a second memory means for memorizing said at least one parameter as a second compensating data for the density of the developed image, when said density falls in said second allowable range; and a selecting means for selecting one of said first and second compensating data on the basis of which process using said parameter for determining the density of the developed image should be carried out.

In this multicolor electrostatic recording apparatus, either one of said first and second compensating data is selected and, on the basis of the selected compensating data, a process using said parameter for determining the density of the developed image is carried out. Therefore, the multicolor printing operation is carried out at a different color density, but in the same hue.

According to another aspect of the present invention, there is provided with a multicolor electrostatic recording apparatus comprising at least two electrostatic recording units for forming at least two different colors, respectively, and means for superimposing the at least two color toner images obtained by said respective units, each of said electrostatic recording unit comprising: an electrostatic latent image carrier; a developing means for developing an electrostatic latent image formed on said carrier with a color toner; a detecting means for detecting the density of the developed image on the basis of a detecting mark which is formed on said carrier as a part of the latent image and developed by said developing means; a discriminating means for comparing said density data detected by said detecting means with an optional desired density value to discriminate whether said density data falls in an allowable range; a control means for feed-back controlling at least one of parameters for determining the density of the developed image so that said density becomes to be in said allowable range, when said density falls out of said allowable range; a memory means for memorizing said at least one parameter as a compensating data for the density of the developed image, when said density falls in said allowable range; and means for conducting, with said compensating data, a process using said parameter for determining the density of the developed image which should be carried out.

In this multicolor electrostatic recording apparatus, the multicolor printing operation is carried out at a desired optional color density on the basis of the density compensating data in accordance with the input optional density parameter.

DESCRIPTION OF THE PREFERRED EMBODIMENTS

Figure 1:
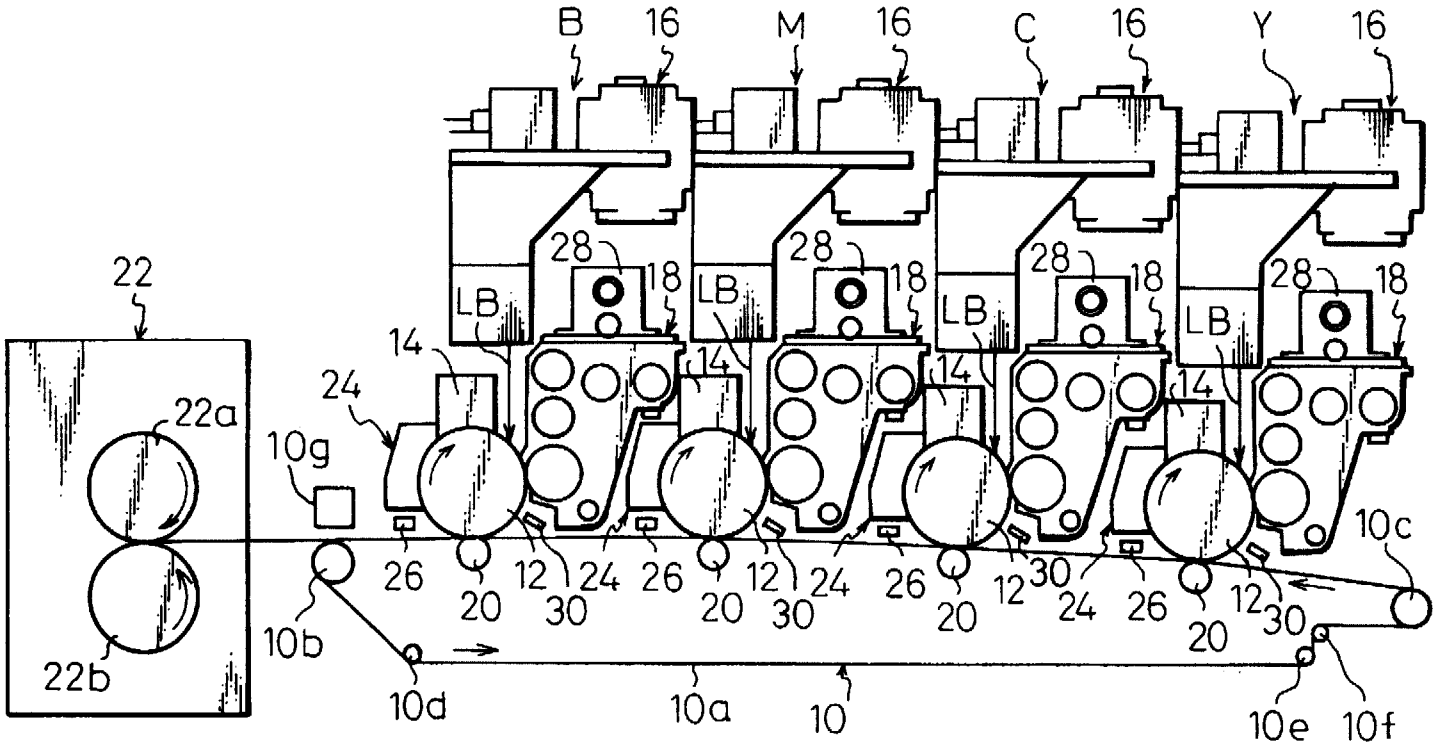
FIG. 1 is an elevational view showing an outline of the multicolor electrostatic recording apparatus of the present invention.

FIG. 1 is a schematic illustration of a high speed laser printer for full color that is a specific example of the multicolor electrostatic recording apparatus of the present invention. This high-speed laser printer includes an endless belt conveyance means 10 for conveying a recording medium such as a recording sheet. This endless belt conveyance means 10 is composed of an endless belt 10*a* made of flexible dielectric material, for example, an appropriate synthetic resin. This endless belt 10*a* is provided around 4 rollers 10*b*, 10*c*, 10*d*, 10*e*. The roller 10*b* functions as a drive roller, which drives the endless belt 10*a* in the arrowed direction by an appropriate drive mechanism not shown in the drawing. The roller 10*c* functions as an idle roller, which also functions as a charging roller to give an electric charge to the endless belt 10*c*. Both rollers 10*d* and 10*e* function as guide rollers, and the roller 10*d* is disposed close to the drive roller 10*b*, and the roller 10*e* is disposed close to the idle roller 10*c*. There is provided a tension roller 10*f* between the idle roller 10*c* and the guide roller 10*e*. By the action of the tension roller 10*f*, the endless belt 10*a* is given an appropriate amount of tension. The upside running section of the endless belt 10*a*, that is, the running section defined by the endless belt 10*a* between the drive roller 10*b* and the idle roller 10*c* forms a recording sheet movement path. A recording sheet is introduced into the recording sheet movement path from the idle roller 10*c* side and discharged outside from the drive roller 10*b* side. When the recording sheet is introduced into the recording sheet movement path from the idle roller 10*c* side, the recording sheet is electrostatically attracted onto the endless belt 10*a* since the endless belt 10*a* is electrically charged. Therefore, the occurrence of positional deviation of the recording sheet from the endless belt 10*a* can be prevented. There is provided an AC discharger 10*g* on the drive roller 10*b* side. By the action of this AC discharger 10*g*, the electric charge is removed from the endless belt 10*a*. Due to the electrical discharging mentioned above, when the recording sheet is sent outside from the drive roller 10*b* side, it can be easily separated from the endless belt 10*a*.

The high speed laser printer is provided with four electrostatic recording units Y, C, M and B, which are disposed in series from the upstream to the downstream along the upside running section of the endless belt 10*a*. In the electrostatic recording units Y, C, M and B, developers having yellow toner components (Y), cyan toner components (C), magenta toner component (M) and black toner component (B) are respectively accommodated. The electrostatic recording units Y, C, M and B have the same structure. The only different point is that the images of yellow, cyan, magenta and black toners are formed on the recording sheet moving along the upside running section on the endless belt 10*a*.

Each of the electrostatic recording units Y, C, M and B includes a photoreceptor drum 12. In the process of recording, the photoreceptor drum 12 is rotated in the arrowed direction shown in the drawing. A precharger 14, which is composed as a corona charger or a scorotron charger, is disposed at an upper position of the photoreceptor drum 12. A rotational surface of the photoreceptor drum 12 is uniformly charged by the precharger 14. An electrostatic latent image is written in the charged region on the photoreceptor drum 12 by an optical writing means, for example, by a laser beam LB emitted from a laser beam scanner 16. That is, the laser beam LB is turned on and off in accordance with the binary image data provided by a computer or a word processor. Due to the foregoing, the electrostatic latent image is written as a dot image.

The electrostatic latent image written on the photoreceptor drum 12 is electrostatically developed by a developing unit 18 using a toner of a predetermined color. The developing unit 18 is disposed on the upstream side of the recording sheet moving path with respect to the photoreceptor drum 12. The electrically charged toner image on the photoreceptor drum 12 is electrostatically transferred onto a recording medium such as a recording sheet by a conductive transfer roller 20 disposed below the photoreceptor drum 12. As illustrated in FIG. 1, the conductive transfer roller 20 comes into contact with the photoreceptor drum 12 via the upside running section of the endless belt 10*a*, so that the recording sheet conveyed by the endless belt 10*a* is given an electric charge, the polarity of which is reverse to that of the charged toner image. The charged toner image is thus electrostatically transferred from the photoreceptor drum 12 onto the recording sheet.

When the recording sheet is introduced from the idle roller 10*c* side of the conveyance means 10 and successively passes through the electrostatic recording units Y, C, M and B, a toner image of 4 colors is superimposed on the recording sheet so that a full color toner image can be formed. The recording sheet then is conveyed from the drive roller 10*b* side of the conveyance means 10 to a heat roller type thermal fixation unit 22, in which the full color image is thermally fixed onto the recording sheet. This thermal fixation will be described, in detail, as follows. The heat roller type thermal fixation unit 22 includes a heat roller 22*a* and a backup roller 22*b*. In the thermal fixing operation, the heat roller 22*a* and the backup roller 22*b* are driven in the arrowed direction in FIG. 1, and the recording sheet is sent from the drive roller 10*b* side of the endless belt conveyance means 10. Then the recording sheet is introduced into a nip portion formed between both rollers 22*a*, 22*b*. At this time, the transferred toner image on the recording sheet is pressured and thermally fused. The transferred toner image is thus thermally fixed onto the recording sheet.

After the transfer process has been completed, residual toner that has not been transferred onto the recording sheet is deposited on the surface of the photoreceptor drum 12 of each of the electrostatic recording units Y, C, M and B. This residual toner is removed from the surface of the photoreceptor drum 12 by a cleaning unit 24 arranged on the downstream side in the recording sheet moving path with respect to the photoreceptor drum 12. In FIG. 1, reference numeral 26 is a light emitting element for discharging, for example, a light emitting diode array, which is used to remove an electric charge from the surface of the photoreceptor drum 12 after the completion of the transfer process. Reference numeral 28 is a developer replenishment container from which an appropriate amount of toner component is replenished to the developing unit 18. Reference numeral 30 is an OD sensor, that is, an optical density sensor. This OD sensor 30 will be explained in detail later.

Figure 2:
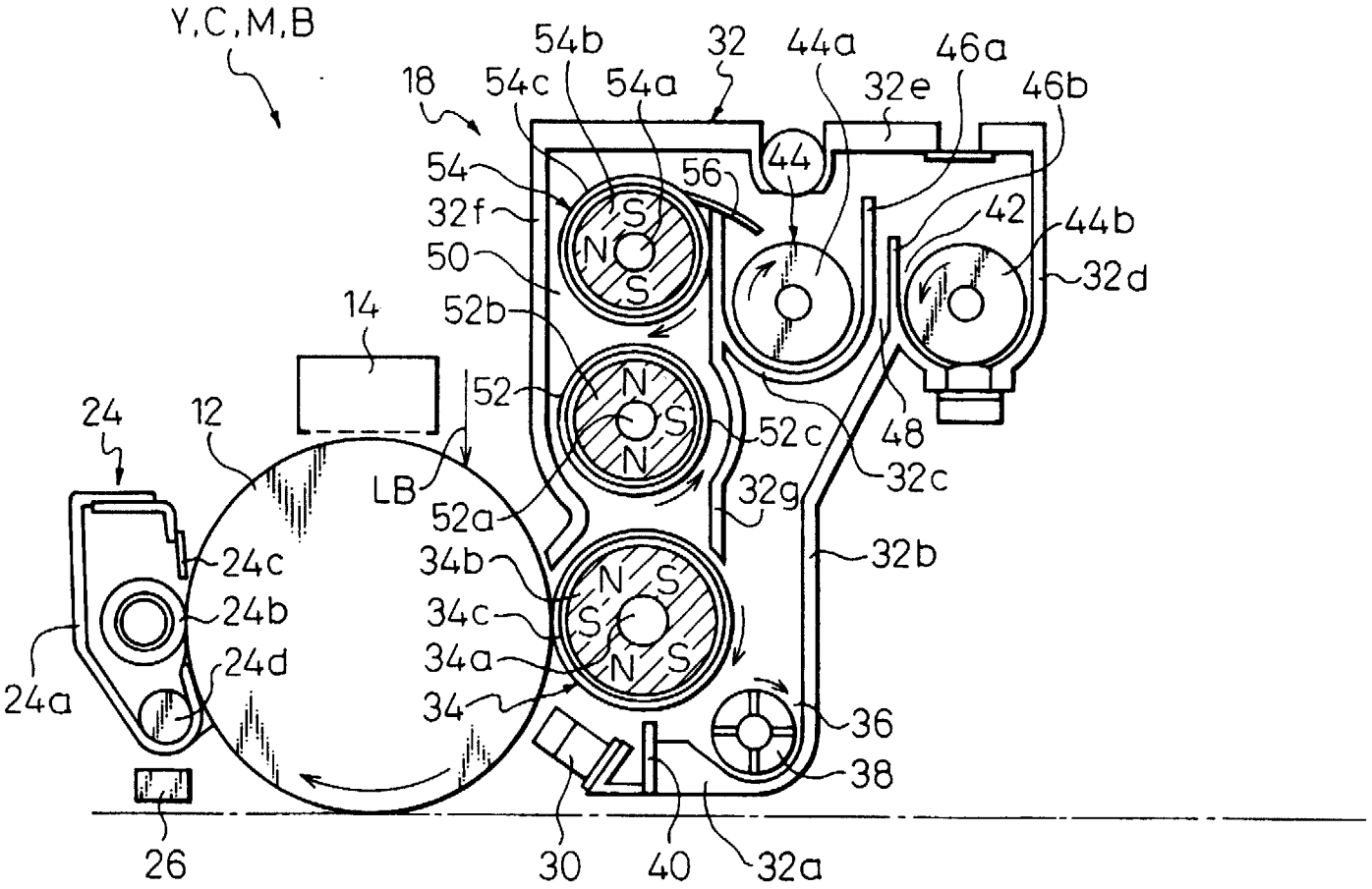
FIG. 2 is a magnified elevational view of one of the electrostatic recording units of the multicolor electrostatic recording apparatus shown in FIG. 1.

FIG. 2 shows a portion of one of the electrostatic recording units Y, C, M, B arranged on the endless conveyance belt 10. In FIG. 2, the recording sheet moving path formed by the upside running section of the endless conveyance belt 10 is illustrated by a one-dotted chain line. As shown in FIG. 2, the developing unit 18 includes a developer holding container 32. In this developer holding container 32, a two-component developer composed of a toner component (fine particles made of colored resin) and a magnetic component (fine magnetic carrier) is accommodated. The developer holding container 32 includes: a first bottom wall portion 32*a*; a first rear wall portion 32*b* extending upward from the rear of this first bottom wall portion 32*a*; a second bottom wall portion 32*c* extending horizontally at an upper end of this first rear wall portion 32*b*; a second rear wall portion 32*d* extending upward from the rear of this second bottom wall portion 32*c*; a top wall portion 32*e* extending horizontally to the front from an upper end of this second rear wall portion 32*d*; and a front wall portion 32*f* extending downward from the front end of this top wall portion 32*e*. Both sides of these wall portions are integrated with the side wall portions (not shown in the drawing). An opening portion is formed between the front end of the first bottom wall portion 32*a* of the developer holding container 32 and the lower end of the front wall portion 32*f*. In the opening portion, a magnet roller, that is, a development roller 34 is arranged in such a manner that a portion of the surface of the development roller 34 is exposed. The development roller 34 includes: a shaft 34*a* fixed and supported by both side walls of the developer holding container 32; a core 34*b* made of magnetic material fixed onto the shaft 34*a*; and a sleeve 34*c* made of nonmagnetic material such as aluminum, rotatably provided around the core 34*b*. When the developing unit 18 is operated, the sleeve 34*c* is rotated in the arrowed direction shown in the drawing. When the developing unit 18 shown in the drawing is installed in the electrostatic recording apparatus, an exposed surface of the development roller 34, that is, a surface of the sleeve 34*c* is opposed to the electrostatic latent image carrier such as a photoreceptor drum.

The first bottom wall portion 32*a* of the developer holding container 32 provides a developer reservoir 36. There is provided a paddle roller 38 in the developer reservoir 36. The paddle roller 38 is rotatably supported by both side walls of the developer holding container 32. When the developing unit 18 is operated, the paddle roller 38 is rotated in the arrowed direction in the drawing. The paddle roller 38 feeds developer stored in the developer reservoir 36 toward the development roller 34. Around the development roller 34, a magnetic brush is formed from the magnetic component of developer, that is, the magnetic carrier. Toner components are electrostatically deposited on the magnetic brush and conveyed by the rotation of the development roller 34 to a region where the development roller 34 is opposed to the photoreceptor drum 12. In order to regulate an amount of developer conveyed to the development region by the development roller 34, a developer regulation blade 40 is attached to the front edge of the first bottom wall portion 32*a*.

A developer stirring section 42 is provided in the second bottom wall portion 32*c* of the developer holding container 32, wherein the developer stirring section 42 is located above the developer reservoir section 36. There is provided a developer stirring unit 44 in this developer stirring section 42. The developer stirring unit 44 is composed of a pair of conveyance screws 44*a*, 44*b* provided between both side walls of the developer holding container 32. This pair of conveyance screws 44*a*, 44*b* are arranged in parallel with each other. As illustrated in FIG. 2, a pair of curved recess portions to receive the spiral blades of the pair of conveyance screws 44*a*, 44*b* are formed on an upper face of the second bottom wall portion 32*c*. Shafts of the conveyance screws 44*a*, 44*b* are rotatably supported by both side walls of the developer holding container 32. When the developing unit 18 is operated, the conveyance screws 44*a*, 44*b* are respectively rotated in the arrowed directions illustrated in the drawing, that is, the conveyance screws 44*a*, 44*b* are respectively rotated in the opposite directions. In this embodiment, the spiral blades of both conveyance screws 44*a*, 44*b* are composed in the manner of a right-handed screw. Therefore, the conveyance screw 44*a* conveys developer to the rear side of the plane of FIG. 2, and the conveyance screw 44*b* conveys developer to the front side of the plane of FIG. 2. There are provided a pair of partition boards 46*a*, 46*b* between the conveyance screws 44*a*, 44*b*, wherein the pair of partition boards 46*a*, 46*b* are arranged perpendicular to the second bottom wall portion 32*c*. The pair of partition walls 46*a*, 46*b* are shorter than the conveyance screws 44*a*, 44*b*, and predetermined clearances are provided between both ends of the partition walls and both side walls of the developer holding container 32. In this way, a developer circulation passage is formed from the conveyance screws 44*a*, 44*b* in the second bottom wall portion 32*c* of the developer holding container 32. That is, developer is circulated along the pair of conveyance screws 44*a*, 44*b* in the following manner. After developer has been conveyed to an end of the conveyance screw 44*a*, the developer turns around the ends of the pair of partition boards 46*a*, 46*b*, so that the developer is moved to the conveyance screw 44*b* side arranged opposite to the conveyance screw 44*a*. After the developer has been conveyed to an end of the conveyance screw 44*b*, it turns around the ends of the pair of partition boards 46*a*, 46*b* and is moved to the conveyance screw 44*a* side. In this way, the developer is circulated along the pair of conveyance rollers 44*a*, 44*b*.

There is provided a communicating passage 48 for communicating the developer reservoir 36 with the developer stirring section 42 between the pair of partition boards 46*a*, 46*b*. An upper opening of this communicating passage 48 forms a developer overflow outlet for the developer in the developer stirring section 32. As can be seen from FIG. 2, the partition board 46*b* is lower than the partition board 46*a*, so that an upper edge of the partition board 46*b* forms a developer overflow edge. Specifically, a portion of the developer circulated by the conveyance screws 44*a*, 44*b* overflows the upper edge of the partition boards 46*b*, that is, a portion of the developer overflows the developer overflow edge and drops into the communicating passage 48. Due to the foregoing, the developer reservoir 36 is supplied with developer from the developer stirring section 42.

As illustrated in FIG. 2, a vertical partition wall portion 32*g* is integrally formed in the front wall section of the second bottom wall portion 32*c* of the developer holding container 32. There is provided a developer rising passage 50 between the vertical partition wall portion 32*g* and the front wall portion 32*f*. As can be seen from FIG. 2, the developer rising passage 50 is located right above the development roller 34. In the developer rising passage 50, there are provided two magnet rollers 52, 54 being vertically aligned with respect to the development roller 34. That is, the magnet rollers 52, 54 are composed in the same manner as the development roller 34 composed as a magnet roller. The magnet rollers 52, 54 include: shafts 52*a*, 54*a* fixed and supported by both side walls of the developer holding container 32; cores 52*b*, 54*b* made of magnetic material fixed onto the shaft 34*a*; and sleeves 52*c*, 54*c* made of nonmagnetic material such as aluminum, rotatably provided around the cores. When the developing unit 18 is operated, the sleeves 52*c*, 54*c* are rotated in the arrowed directions shown in the drawing. The core 34*b* of the development roller 34, the core 52*b* of the magnet roller 52, and the core 54*b* of the magnet roller 54 are locally magnetized along the respective peripheries as illustrated in FIG. 2. When the cores 34*b*, 52*b*, 54*b* are locally affected by the magnetic field, they can be locally magnetized. The magnetic poles of the core 34*b* of the development roller 34 are arranged in such a manner that the developer can be conveyed from the developer reservoir 36 to the development region in accordance with the rotation of the sleeve 34*c* and then the developer can be conveyed to a position on the lower side of the magnet roller 52. The magnetic poles of the core 52*b* of the magnet roller 52 are arranged in such a manner that the developer can be pulled up from the top of the development roller 34 in accordance with the rotation of the sleeve 52*c* and conveyed to a position on the lower side of magnet roller 54. The magnetic poles of the core 54*b* of the magnet roller 54 are arranged in such a manner that the developer can be pulled up from the top of the magnet roller 52 in accordance with the rotation of the sleeve 54*c* and conveyed to a position on the top of the magnet roller 54. Due to the above structure, after the developer has been conveyed to the development region by the development roller 34, it is raised to the top of the top magnet roller 54 without being directly returned to the developer reservoir 36.

A scraper member 56 is provided at the upper end of the vertical partition wall 32*g*. A fore end of this scraper member 56 comes into contact with the surface of the magnet roller 54 at a position a little behind the top of the magnet roller 54. After the developer has been raised to the top of the magnet roller 54, it is supplied to the conveyance screw 44*a* side of the developer stirring section 42 by the action of the scraper member 56.

In short, the developer is circulated as follows. The developer is supplied from the developer stirring section 42 to the developer reservoir 36 via the communicating passage 48. Then the developer is conveyed from the developer reservoir 36 to the developing region by the development roller 34. After the developer has passed through the developing region, it is successively pulled up by the magnet rollers 52, 54, and returned to the developer stirring section 42 via the scraper member 56. As described above, when the developing unit 18 is operated, the developer is continuously circulated in the developer holding container 32, so that the developer reservoir 36 is supplied with a developer that has been sufficiently stirred. In this connection, when the developer is sufficiently stirred, the toner components and the magnetic components are subjected to a sufficiently high triboelectric charging, and the toner components are uniformly distributed in the magnetic components.

As illustrated in FIG. 2, the cleaning unit 24 includes: a toner recovery container 24a having an opening in which a portion of the photoreceptor drum 12 is received; a fur brush 24b arranged at a position close to the opening in the toner recovery container 24a; a toner scraping blade 24c arranged along the upper edge of the opening of the toner recovering container 24a; and a conveyance screw 24d arranged at the bottom of the toner recovery container 24a. Residual toner is removed from the surface of the photoreceptor drum 12 by the fur brush 24b, and toner further remaining on the surface of the photoreceptor drum 12 is scraped off by the scraping blade 24c. After the residual toner has been removed from the surface of the photoreceptor drum 12 by the fur brush 24b and the scraping blade 24c, it is temporarily recovered into the container 24a, however, the thus recovered toner is conveyed from the toner recovery container 24a to a predetermined position by the conveyance screw 24d.

Figure 3:
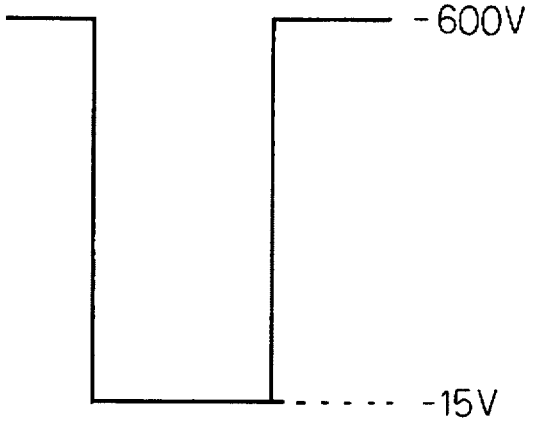
FIG. 3 is a schematic illustration for explaining the development process of an electrostatic latent image.

The development process carried out in the above developing unit 18 will be described in detail as follows. For example, when the toner components in the developer are negatively charged, a uniformly negatively charged region is formed on the rotational surface of the photoreceptor drum 12 by the precharger 14. When the charged region on the photoreceptor drum 12 is irradiated with a laser beam LB emitted from the laser beam scanner 16, the negative electric charge is discharged from the irradiated portion, so that an electric potential is generated. In other words, an electrostatic latent image is written in the charged region on the photoreceptor drum 12, and the portion in which the electrostatic latent image has been written is generally referred to as "a well of electric charge". For example, when the electric potential of the charged region on the photoreceptor drum 12 is −600 V as shown in FIG. 3, the electric potential of the electrostatic latent image is lowered to about −15 V as an absolute value. On the other hand, the development roller 34 is impressed with a negative bias voltage, for example, −400 V. In this way, an electric field is formed between the development roller 34 and the photoreceptor drum 12. The negatively charged toner components are drawn toward the photoreceptor drum 12 by the action of the electric field formed between the development roller 34 and the photoreceptor drum 12. At this time, the toner components T are deposited at a position of the electrostatic latent image (the well of electric charge), so that the position of the electrostatic latent image is electrically charged. Specifically, the negatively charged toner components are deposited at the position of the electrostatic latent image in such a manner that the electric potential −15 V at the position of the electrostatic latent image is increased to the background electric potential −600 V as an absolute value. Accordingly, the more the amount of electric charge on the toner components is increased, the smaller the amount of toner components deposited at the position of the electrostatic latent image. The less the amount of electric charge of toner components is decreased, the larger the amount of toner components deposited at the position of the electrostatic latent image. That is, in the process of development of the electrostatic latent image, the development density, that is, the amount of deposited toner is affected by the amount of electric charge of toner components. Further, the amount of electric charge of toner components is greatly affected by the environmental temperature and humidity. The amount of deposited toner in the process of development is changed by an intensity of the development bias voltage impressed upon the development roller 34. Also, the amount of deposited toner in the process of development is changed when the characteristic of the photoreceptor drum 12 is deteriorated.

In order to maintain a predetermined hue (color balance) when the images of yellow, cyan and magenta toners are superimposed so as to conduct the recording of chromatic colors, it is necessary to regulate an amount of deposited toner (development density) for each dot at a predetermined value when a toner image of each color is developed. Since an amount of deposited toner for each dot is very small, usually, the toner deposition amount is defined as an overall toner deposition amount (weight) in the case where 1 $m^2$ of recording sheet is subjected to solid recording. For example, in this embodiment, it is possible to provide a predetermined hue when the toner deposition amount is defined as follows. In the case of a yellow toner image, the toner deposition amount is defined to be 4.2±0.4 $g/m^2$. In the case of a cyan toner image, the toner deposition amount is defined to be 5.2±0.4 $g/m^2$. In the case of a magenta toner image, the toner deposition amount is defined to be 4.7±0.4 $g/m^2$. In this connection, for example, when a red toner image is formed from yellow and magenta toners, it is preferable that the weight of deposited yellow toner is the same as the weight of deposited magenta toner. However, when consideration is given to the characteristic of color material of each toner component and the electric charging characteristic, it is actually impossible to make the toner deposition amounts of yellow and magenta toners to be the same for providing a red toner image. Therefore, the predetermined value of deposited toner of each color fluctuates a little as described before.

As described above, in this embodiment, when multicolor recording is conducted in the normal mode, the toner deposition amount to obtain a yellow toner image is defined to be 4.2±0.4 $g/m^2$, the toner deposition amount to obtain a cyan toner image is defined to be 5.2±0.4 $g/m^2$, and the toner deposition amount to obtain a magenta toner image is defined to be 4.7±0.4 $g/m^2$. However, when, for example, multicolor recording is conducted at a half density while the predetermined hue is maintained, that is, when multicolor recording is conducted in the economical mode, it is not appropriate that an amount of deposited toner of each color is simply reduced to a half. In this case, the deposition amount of yellow toner is defined to be 3.6±0.4 $g/m^2$, the deposition amount of cyan toner is defined to be 4.5±0.4 $g/m^2$, and the deposition amount of magenta toner is defined to be 4.0±0.4 $g/m^2$. When the deposition amount of toner of each color is defined as described above, it is possible to conduct the multicolor recording at half the density of the normal mode while the predetermined hue is maintained. When the density is changed while the predetermined hue is maintained as described above, it is possible to determine the development density of each color in accordance with the Munsell color system as is well known. Concerning the deposition amount of toner required for obtaining a black toner image, which is not directly related to the hue of a chromatic toner image, for example, the deposition amount of toner is defined to be 5.0±0.4 $g/m^2$ in the normal mode, and 3.0±0.4 $g/m^2$ in the economical mode.

Figure 4:
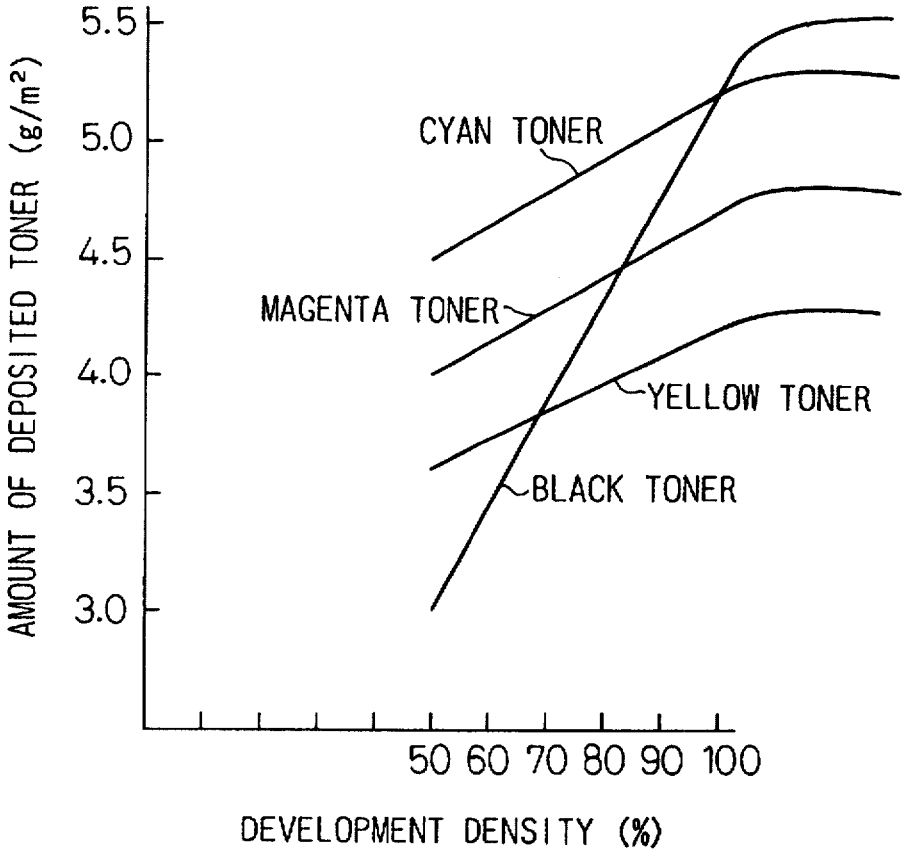
FIG. 4 is a graph showing the relationship between the development density and the amount of deposited toner of each color.

On the graph shown in FIG. 4, there is shown a relation between the deposition amount of toner of each color and the development density. On the graph, the development density of toner component of each color in the normal mode is defined as 100% which is used as a reference of conversion. As described before, an amount of deposited toner is mainly determined by an amount of electric charge given to the toner itself. Further, the amount of electric charge given to the toner is greatly affected by the environmental temperature and humidity. Consequently, when the environmental temperature and humidity change, the hue of multicolor recording, that is, the color balance of multicolor recording fluctuates. However, according to the present invention, as described below, even when the environmental temperature and humidity change, it is possible to maintain the color balance in the process of multicolor recording. Further, according to the present invention, as described below, it is possible to quickly switch between the normal and economical modes in multicolor recording. Furthermore, it is possible to provide full color images of various development densities while the color balance is maintained.

Figure 5:
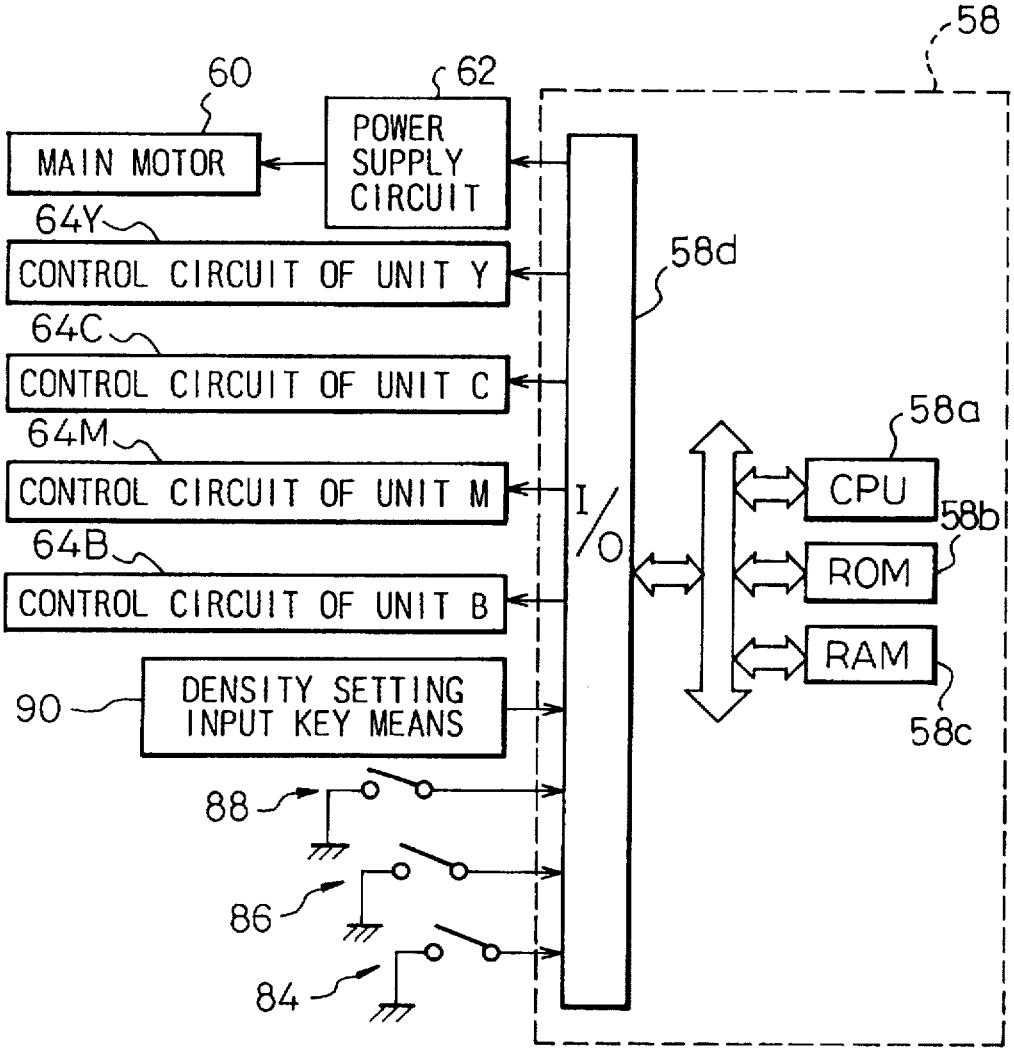
FIG. 5 is a control block diagram of the multicolor electrostatic recording apparatus shown in FIG. 1.
Figure 6:
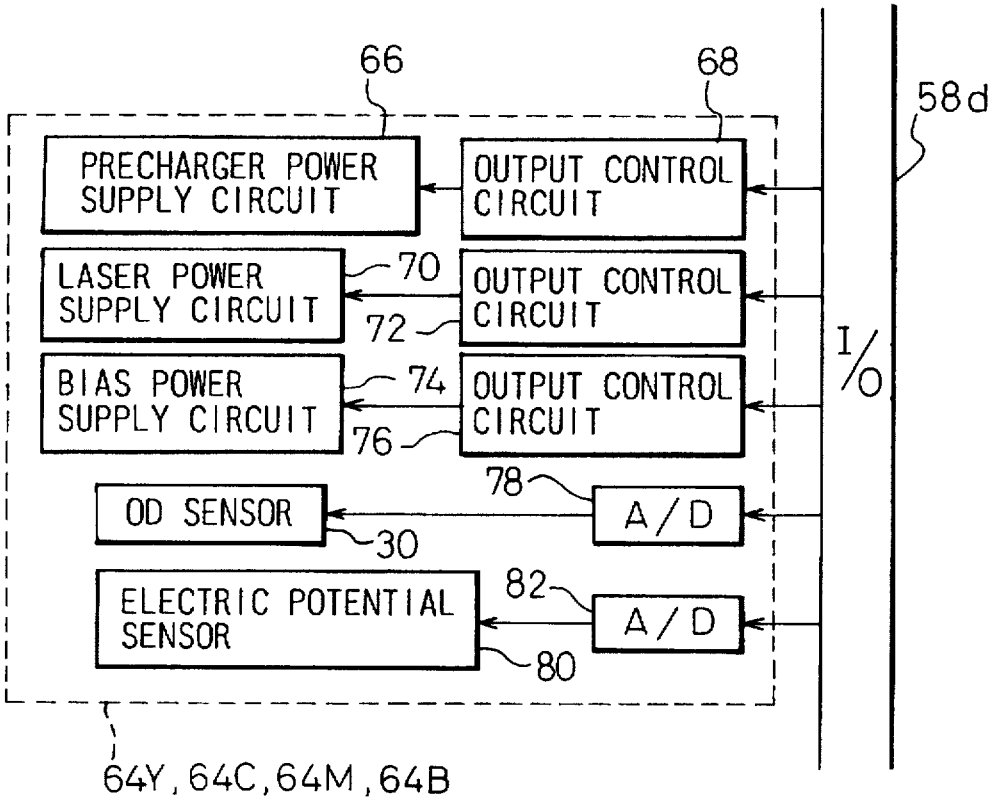
FIG. 6 is a block diagram showing the details of a portion of the control block diagram shown in FIG. 4.

FIG. 5 is a control block diagram of the high speed laser printer shown in FIG. 1. Reference numeral 58 denotes a main control circuit of the high speed laser printer. As can be seen from FIG. 5, the main control circuit 58 is composed of a microcomputer, which includes: a central processing unit (CPU) 58*a*; a read-on-memory (ROM) 58*b* in which an operation program and constants to control the entire operation of the multicolor electrostatic recording apparatus are stored; a random-access-memory (RAM) 58*c* in which data is temporarily stored, wherein the data can be written in and read from the memory; and an input and output (I/O) interface 58*d*. Reference numeral 60 denotes a main motor of the high speed laser printer shown in FIG. 1. This main motor 60 drives an endless belt conveyance means 10, a photoreceptor drum 12, a developing unit 18 and the like. Reference numeral 62 denotes a power supply circuit of the main motor 60. This power supply circuit 62 is controlled by the main control circuit 58. Reference numerals 64Y, 64C, 64M and 64B respectively denote the control circuits of electrostatic recording units Y, C, M and B. These control circuits 64Y, 64C, 64M and 64B have the same structure, which is illustrated in FIG. 6. As can be seen from FIG. 6, each of the control circuits 64Y, 64C, 64M and 64B includes: a power supply circuit 66 for the precharger 14; an output control circuit 68 for this power supply circuit 66; a laser power supply circuit 70 for the laser beam scanner 16; an output control circuit 72 for the laser power supply circuit 70; a bias power supply circuit 74 for impressing a development bias voltage upon the development roller 34 of the developing unit 18; and an output control circuit 76 for the bias power supply circuit 74, wherein the output control circuits 68, 72, 76 are controlled by the primary control circuit 58. Each of the control circuits 64Y, 64C, 64M and 64B includes an OD sensor 30. Detection data of this OD sensor 30 is taken into the primary control circuit 58 through an A/D converter 78. Each OD sensor 30 detects the optical density (development density) of a detection mark formed on the photoreceptor drum 12. In this connection, the detection mark is obtained when the electrostatic latent image of a predetermined pattern is written on the photoreceptor drum 12 with the laser beam scanner 16 and developed with the toner component in the developing unit 34. When the optical density of the detection mark is detected by the OD sensor 30, the amount of deposited toner can be known. Further, each of the control circuits 64Y, 64C, 64M and 64B includes an electric potential sensor 80. In order to simplify the drawings, this electric potential sensor 80 is omitted in FIGS. 1 and 2, however, this electric potential sensor 80 is arranged between the precharger 14 and the electrostatic latent image writing position (laser beam LB). The electric potential sensor 80 detects an electric potential on the charged region formed on the photoreceptor drum 12 by the precharger 14. Detection data of the electric potential sensor 80 is taken into the primary control circuit 58 through the A/D converter 82. In this connection, in FIG. 5, reference numeral 84 denotes a power switch, reference numeral 86 denotes a development density correction switch, reference numeral 88 denotes a mode selection switch, and reference numeral 90 denotes a density setting input key means to which an arbitrary development density correction value is inputted so as to set the density.

According to the high speed laser printer of the present invention, even when the constitutive parts such as a photoreceptor drum and a semiconductor laser are subjected to deterioration with time so that the characteristics of the parts are changed, and even when the environmental temperature and humidity fluctuate, it is possible to guarantee the multicolor recording in which the hue is kept constant at all times. It can be accomplished when the development density of toner component of each color, that is, the amount of deposited toner, is corrected in the multicolor recording in accordance with the change in the characteristics of parts or the change in the environmental temperature and humidity.

Figure 7:
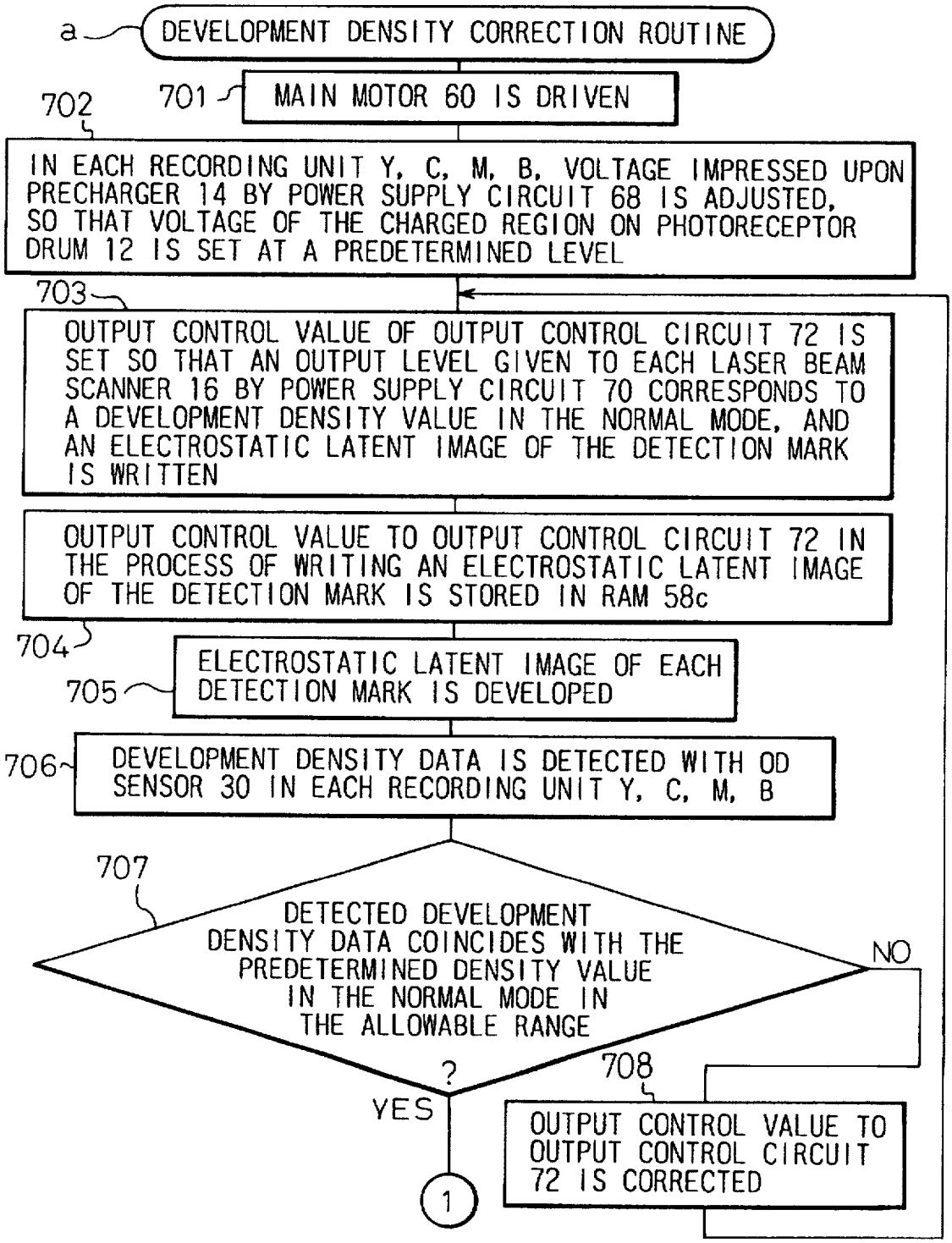
FIGS. 7 and 8 are a series of flow charts showing the development density correction routine to correct a setting density value in the normal and economical modes, wherein an output level to the laser beam scanner is used as a control parameter.
Figure 8:
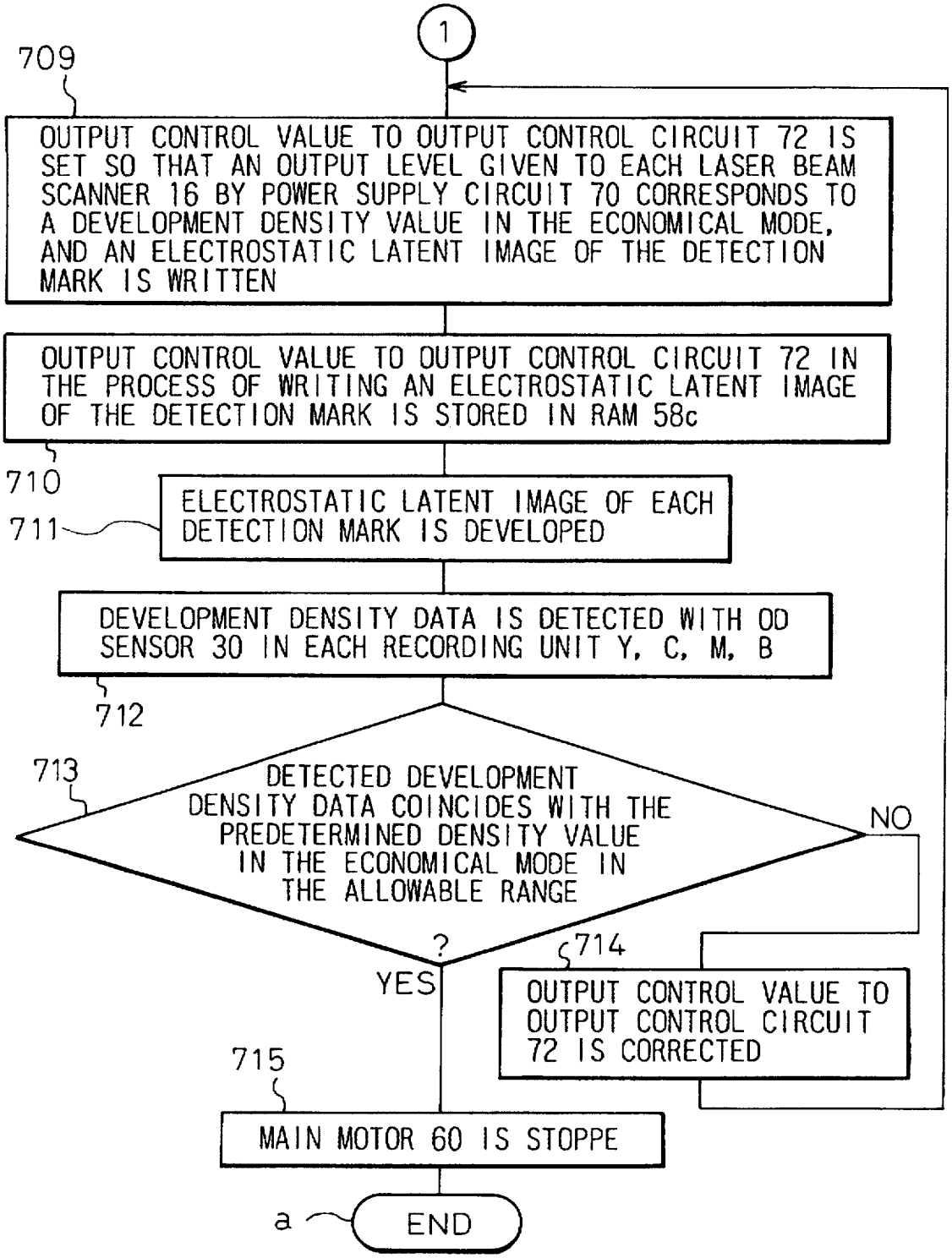

There is shown a development density correction routine in FIGS. 7 and 8. With reference to the development density correction routine, the development density correction of the present invention will be explained below. In this connection, the development density correction routine shown in FIGS. 7 and 8 is carried out when the power switch 84 is turned on.

In step 701, in order to drive the main motor 60, the primary control circuit 58 outputs an ON-signal to the power circuit 62 through the I/O 58*d*. Due to the foregoing operation, the photoreceptor drum 12 is rotated and the developing unit 18 is operated. Next, in step 702, in each of the electrostatic recording units Y, C, M and B, a voltage impressed upon the precharger 14 by the power circuit 66 is adjusted when an output control value of the output control circuit 68 sent from the primary control circuit 58 is controlled. In this way, an electric potential of the charged region on the photoreceptor drum 12 can be maintained at a predetermined value. That is, the electric potential of the charged region on the photoreceptor drum 12 is detected by the potential sensor 80, the detection data is taken in by the primary control circuit 58 through the A/D converter 82, this potential data is compared with a predetermined setting value, and an output control value sent to the output control circuit 68 is subjected to feedback control. Due to the foregoing operation, the electric potential of the charged region on the photoreceptor drum 12 can be maintained at a predetermined value, for example, −600 V. As a result, even when the characteristic of the photoreceptor drum 12 is deteriorated with time, a predetermined electric potential level can be guaranteed in the charged region on the photoreceptor drum 12.

Figure 9:
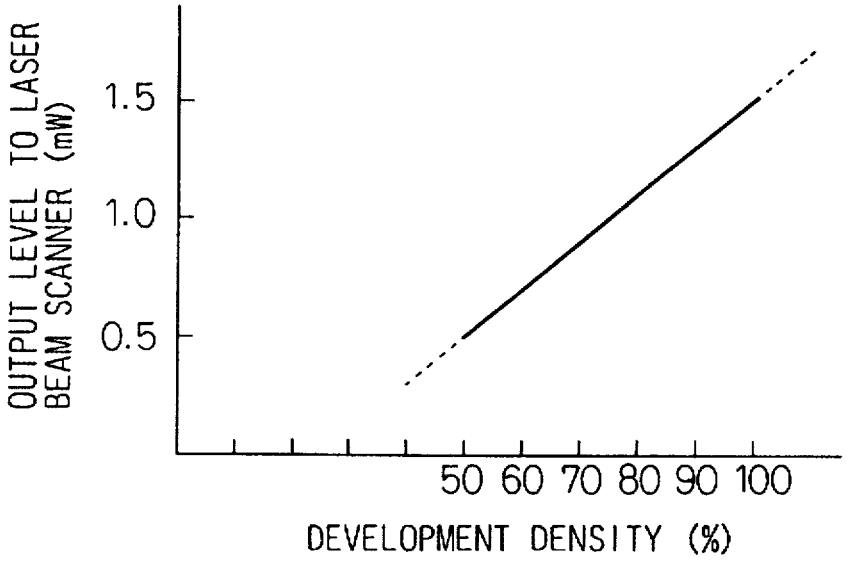
FIG. 9 is a graph showing the relationship between the development density and the output level to the laser beam scanner.

In step 703, in each of the electrostatic recording units Y, C, M, B, an electrostatic latent image of the detection mark is written in the charged region on the photoreceptor drum 12 with the laser beam LB sent from the laser beam scanner 16. In this case, an output control value outputted from the primary control circuit 58 to the output control circuit 72 is set in such a manner that an output level of each laser power supply circuit 70 to the laser beam scanner 16 corresponds to a predetermined density value in the normal mode. That is, when the primary control circuit 58 outputs a control signal to the output control circuit 72 in accordance with the output control value that has been set in the above manner, the output level of the laser power supply circuit 70 to the laser beam scanner 16 corresponds to a predetermined density value in the normal mode. For example, under the condition that an electric potential of the charged region on the photoreceptor drum 12 is −600 V and further the development bias voltage impressed upon the development roller 34 is −400 V, the output control value to the output control circuit 72 is set so that the laser beam scanner 16 can be operated by the laser power supply circuit 70 with an electric power of 1.5 mW. At this time, the laser beam scanner 16 generates a laser beam LB, the intensity of which corresponds to the control value. As shown in FIG. 9, there is a relation between the output level of the laser beam scanner 16 and the development density. In this embodiment, it is defined that the development density obtained when the laser beam scanner 16 is operated with an electric power of 1.5 mW is the density value 100% in the normal mode. However, even if the laser beam scanner 16 is operated with an electric power of 1.5 mW, the development density value 100% is not necessarily obtained in the normal mode. The reason is that an amount of deposited toner corresponding to the development density value 100% can not be necessarily obtained due to the fluctuation of electric charge of toner of each color as described before. In any case, in step 703, when the laser beam scanner 16 is operated by the electric power of 1.5 mW, an electrostatic latent image of the detection mark is written in the charged region on the photoreceptor drum 12.

In step 704, an output control value to the output control circuit 72 in the case of writing the electrostatic latent image of the detection mark is stored in RAM 58*c*. Next, in step 705, the electrostatic latent image of the detection mark is developed in each developing unit 18 with the toner component of each color. At this time, the development bias voltage impressed upon the development roller 34 by the bias power supply circuit 74 is controlled to be −400 V by the output control circuit 76 as described before.

In step 706, the optical density value of the development detection mark is detected by the OD sensor 30, and the detection optical density value is taken into the primary control circuit 58 through the A/D converter 78 as the development density data of the detection mark which represents an amount of deposited toner. Next, in step 707, the detection development density data is compared with a predetermined density value corresponding to the amount of deposited toner of each of the electrostatic recording units Y, C, M, B in the normal mode. In this case, the amount of deposited toner of each electrostatic recording unit is described as follows. In the electrostatic recording unit Y, the predetermined amount of deposited toner is 4.2±0.4 g/m$^2$. In the electrostatic recording unit C, the predetermined amount of deposited toner is 5.2±0.4 g/m$^2$. In the electrostatic recording unit M, the predetermined amount of deposited toner is 4.7±0.4 g/m$^2$. In the electrostatic recording unit B, the predetermined amount of deposited toner is 5.0±0.4 g/m$^2$. Then it is judged whether or not the detection development density data coincides with the predetermined density value in the allowable range (±0.4 g/m$^2$). When the detection development density data does not coincide with the predetermined density value in the allowable range in the normal mode, the program advances to step 708. In step 708, the correction of an output level from the laser power supply circuit 70 to the laser beam scanner 16 is conducted when the output control value to the output control circuit 72 is changed by a predetermined value. For example, when the detection development density data is lower than the predetermined density value in the normal mode, an output control value to the output control circuit 72 is raised by a predetermined value so that the laser beam scanner 16 can be operated with an electric power, the intensity of which is higher than 1.5 mW. When the detection development density data is higher than the predetermined density value in the normal mode, an output control value to the output control circuit 72 is lowered by a predetermined value so that the laser beam scanner 16 can be operated by electric power, the intensity of which is lower than 1.5 mW. In this connection, the predetermined density value in the normal mode is previously stored in ROM 58*b* as a constant.

After that, the program is returned to step 703, and the same operation is repeated. The repetition is continued until the detection development density data coincides with the predetermined density value in the allowable range in the normal mode in step 707. At this time, the output control value to the output control circuit 72, which is stored in RAM 58*c*, is rewritten and renewed at any time, and the last renewed value is employed as a normal mode correction value for the output control value to the output control circuit 72.

In step 707, when the detection development density data coincides with the predetermined density value in the allowable range in the normal mode, the program advances to step 709. In step 709, in each of the electrostatic recording units Y, C, M and B, an electrostatic latent image of the detection mark is written in the charged region on the photoreceptor drum 12 with the laser beam LB sent from the laser beam scanner 16. In this case, the output control value to the output control circuit 72 is set in such a manner that the output level of the laser power supply circuit 70 to the laser beam scanner 16 corresponds to the predetermined density value in the economical mode. In this embodiment, the predetermined density value in the economical mode is a half of the density value in normal mode. That is, under the above condition, the output control value to the output control circuit 72 is set so that the laser beam scanner 16 can be operated with an electric power of 0.5 mW. As illustrated in FIG. 9, when the laser beam scanner 16 is operated with an electric power of 0.5 mW, an amount of deposited toner corresponding to the density value 50%, which is a half of the development density value 100% in the normal mode, can be provided. However, as described before, due to the fluctuation of electric charge of toner component of each color, an amount of deposited toner corresponding to the development density value in the economical mode is not necessarily provided. In any case, when the laser beam scanner 16 is operated with an electric power of 0.5 mW in step 709, an electrostatic latent image is written in the charged region on the photoreceptor drum 12.

In step 710, an output control value to the output control circuit 72 in the case of writing the electrostatic latent image of the detection mark is stored in RAM 58*c*. Next, in step 711, the electrostatic latent image of the detection mark is developed by each developing unit 18*c* with a toner of each color.

In step 712, an optical density value of the development detection sensor is detected by the OD sensor 30. The detected optical density value is taken into the primary control circuit 58 through the A/D converter 78 as the development density data of the detection mark, wherein the development density data represents an amount of deposited toner. Next, in step 713, the detection development density data is compared with a predetermined density value corresponding to the amount of deposited toner of each of the electrostatic recording units Y, C, M, B in the economical mode. In this case, the amount of deposited toner of each electrostatic recording unit is described as follows. In the electrostatic recording unit Y, the predetermined amount of deposited toner is 3.6±0.4 g/m$^2$. In the electrostatic recording unit C, the predetermined amount of deposited toner is 4.5±0.4 g/m$^2$. In the electrostatic recording unit M, the predetermined amount of deposited toner is 4.0±0.4 g/m$^2$. In the electrostatic recording unit B, the predetermined amount of deposited toner is 3.0±0.4 g/m$^2$. Then it is judged whether or not the detection development density data coincides with the predetermined density value in the allowable range. When the detection development density data does not coincide with the predetermined density value in the allowable range in the economical mode, the program advances to step 714. In step 714, the correction of an output level from the laser power supply circuit 70 to the laser beam scanner 16 is conducted when the output control value to the output control circuit 72 is changed by a predetermined value. For example, when the detection development density data is lower than the predetermined density value in the normal mode, an output control value to the output control circuit 72 is raised by a predetermined value so that the laser beam scanner 16 can be operated by electric power, the intensity of which is higher than 1.5 mW. When the detection development density data is higher than the predetermined density value in the normal mode, an output control value to the output control circuit 72 is lowered by a predetermined value so that the laser beam scanner 16 can be operated by electric power, the intensity of which is lower than 1.5 mW. In this connection, the predetermined density value in the economical mode is previously stored in ROM **58*b*** as a constant.

After that, the program is returned to step 709, and the same operation is repeated. The repetition is continued until the detection development density data coincides with the predetermined density value in the allowable range in the normal mode in step 713. At this time, the output control value to the output control circuit 72, which is stored in RAM **58*c*, is rewritten and renewed at any time, and the last renewed value is employed as an economical mode correction value for the output control value to the output control circuit 72. Next, the program advances to step 715. In step 715, the main motor 60** is temporarily stopped, and the high speed laser printer is ready for an actual recording operation.

When the mode selection switch 88 is in a condition of OFF, multicolor recording is conducted in the normal mode. In this case, when an electrostatic latent image is written by each of the electrostatic recording units Y, C, M and B, an output level of the laser power supply circuit 70 to the laser beam scanner 16 is determined in accordance with the correction value in the normal mode stored in RAM **58*c*. Due to the foregoing, the amount of deposited toner of each color, that is, the development density is guaranteed in the normal mode of multicolor recording so that the hue can be appropriately maintained. On the other hand, when the mode selection switch 88 is in a condition of ON, multicolor recording is conducted in the economical mode. In this case, when an electrostatic latent image is written by each of the electrostatic recording units Y, C, M and B, an output level of the laser power supply circuit 70 to the laser beam scanner 16 is determined in accordance with the correction value in the economical mode stored in RAM 58*c***. Due to the foregoing, the amount of deposited toner of each color, that is, the development density is guaranteed in the economical mode of multicolor recording so that the hue can be appropriately maintained.

In the development density correction routine shown in FIGS. 7 and 8, the predetermined density values in the normal and economical modes may be set as the predetermined amounts of deposited toner. In this case, the graph shown in FIG. 4 is held in the primary control circuit 58 as a ROM table. An output value of the OD sensor 30 is inputted onto the ROM table and converted into a toner deposition amount. The thus converted toner deposition amount is compared with the predetermined toner deposition amount.

The development density correction routine shown in FIGS. 7 and 8 is carried out when the operation of the high speed printer starts, that is, when the power supply switch 84 is turned on. However, when an operator turns on the development density correction switch 86, the routine may be appropriately carried out. When the recording operation is not carried out by the high speed laser printer over a predetermined period of time under the condition that the power supply switch 84 of the high speed laser printer is turned on, for example, when the recording operation is not carried out over one hour, the development density routine shown in FIGS. 7 and 8 may be automatically carried out.

Figure 10A:
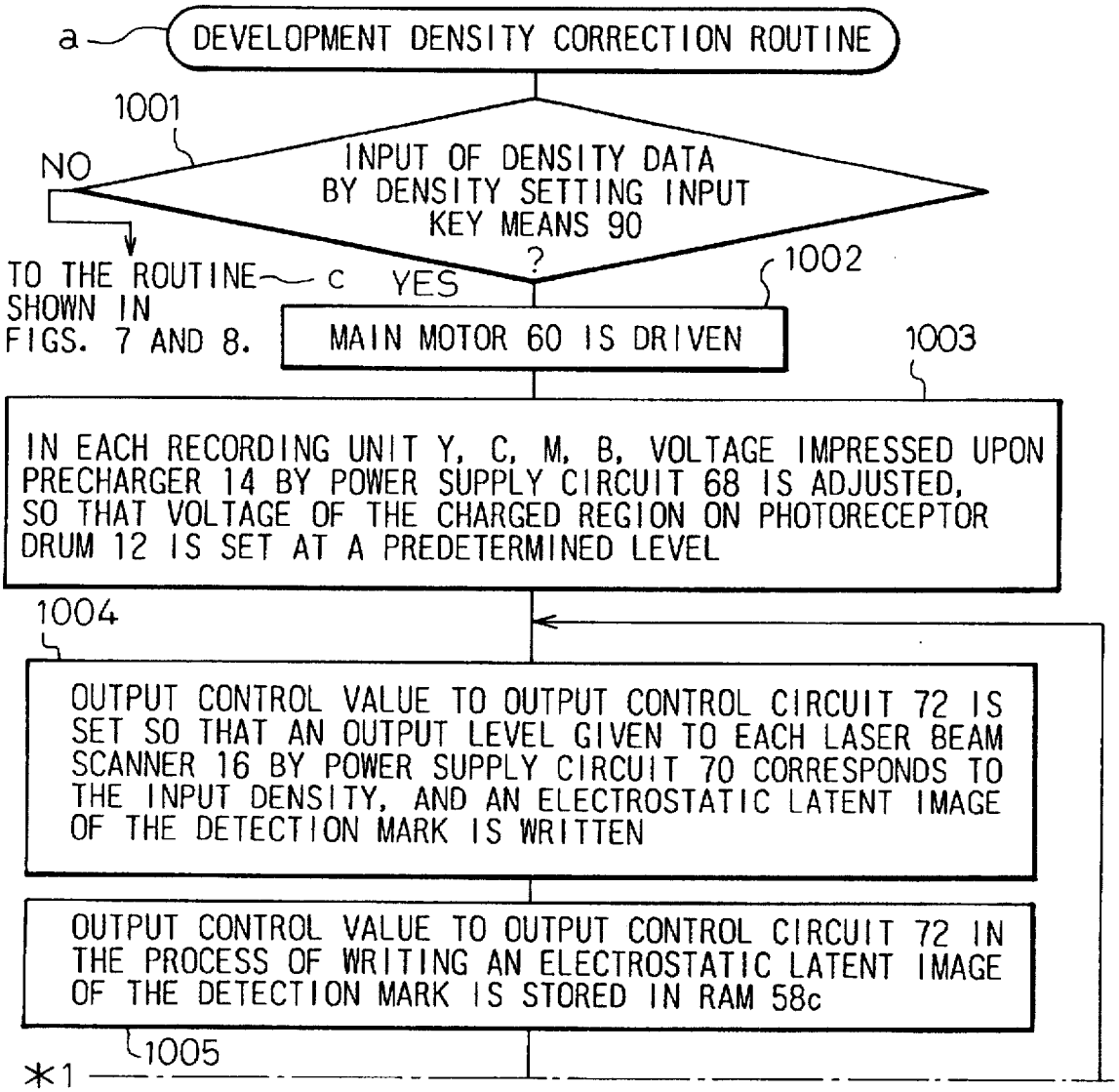
FIG. 10((*a*) and (*b*)) is a flow chart showing a development density correction routine to correct an arbitrary input setting density value, wherein an output level to the laser beam scanner is used as a control parameter.
Figure 10B:
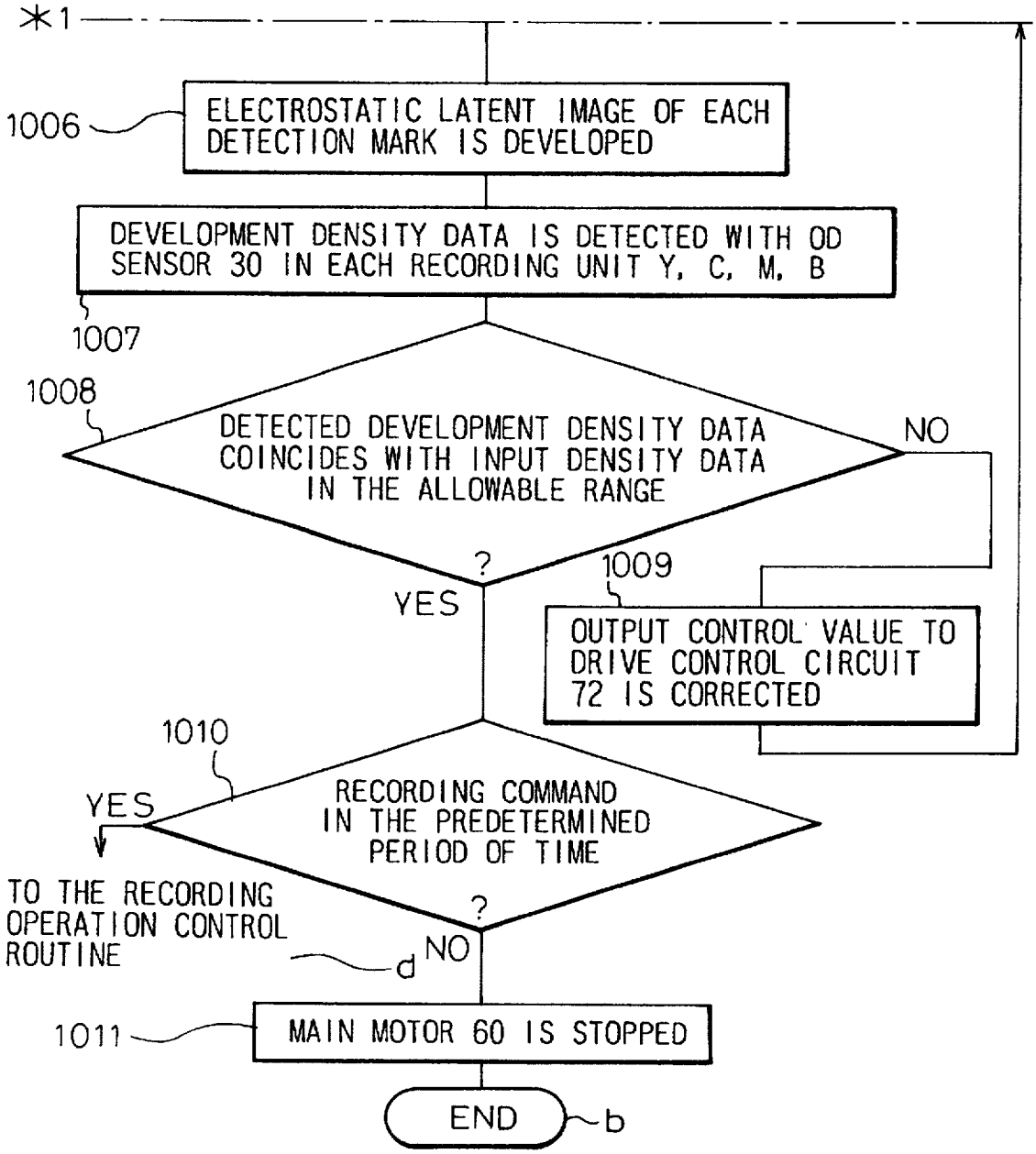

In the development density correction routine shown in FIGS. 7 and 8, the development density correction of multicolor recording is conducted only in the two cases of the normal and economical modes. However, according to the multicolor recording apparatus of the present invention, even when arbitrary density data is inputted by the density setting input key means 90, it is possible to correct the development density with respect to the arbitrary input density data. With reference to the development density correction routine shown in FIG. 10, the development density correction to correct the arbitrary input density data will be explained as follows. In this connection, the development density correction routine shown in FIG. 10 is carried out when the development density correction switch 86 is turned on after the arbitrary density data has been inputted using the density setting input key means 90.

In step 1001, it is judged whether or not the density data has been inputted by the density setting input key means 90. After the density data has been inputted, the program advances to step 1002. In step 1002, in order to drive the main motor 60, the primary control circuit 58 outputs an ON signal to the power supply circuit 62 through the I/O **58*d*. Due to the foregoing, the photoreceptor drum 12 is rotated and the developing unit 18 is operated at the same time. In this connection, when the image density data has not been inputted by the density setting input key means 90, the development density correction routine shown in FIGS. 7 and 8 is carried out by switching ON the development density correction switch 86. Next, in step 1003, in each of the electrostatic recording units Y, C, M and B, a voltage impressed upon the precharger 14 by the power supply circuit 66 is adjusted by controlling the output control value of the primary control circuit 58 to the output control circuit 68. In this way, an electric potential in the charged region on the photoreceptor drum 12** can be maintained at −600 V.

In step 1004, in each of the electrostatic recording units Y, C, M and B, the electrostatic latent image of the detection mark is written in the charged region on the photoreceptor drum 12 by the laser beam LB sent from the laser beam scanner 16. In this case, the output control value inputted into the output control circuit 72 is set in such a manner that the output level of the laser power supply circuit 70 sent to the laser beam scanner 16 corresponds to the input density data. That is, when a control signal is outputted to the output control circuit 72 by the primary control circuit 58 in accordance with the output control value that has been set as described above, the output level sent to the laser beam scanner 16 from the laser power supply circuit 70 corresponds to the input density data. For example, when the input density data inputted by the density setting input key means 90 is a density value 75% with respect to the development density value 100% in the normal mode, the output control value given to the output control circuit 72 is set, as can be seen from the graph in FIG. 9, so that the laser beam scanner 16 can be operated by the electric power of 1.0 mW in the laser power supply circuit 70. At this time, it is possible to provide an amount of deposited toner corresponding to the development density value 75% with respect to the development density value in the normal mode. However, for the reasons described above, an amount of deposited toner corresponding to the development density value 75% can not be necessarily provided. In any case, in step 1004, when the laser beam scanner 16 is operated by the electric power corresponding to the input density data, the electrostatic latent image of the detection mark is written in the charged region on the photoreceptor drum 12.

In step 1005, an output control value given to the output control circuit 72 in the case of writing the electrostatic latent image of the detection mark is stored in RAM 58*c*. Next, in step 1006, the electrostatic latent image of the detection mark is developed by the toner component of each color in each developing unit 18.

In step 1007, an optical density value of the development detection mark is detected by the OD sensor 30. The detected optical density value is taken into the primary control circuit 58 through the A/D converter 78 as the development density data of the detection mark, wherein the development density data represents an amount of deposited toner. Next, in step 1008, the thus detected development density data is compared with the input density data, and it is judged whether or not the detected development density coincides with the input density data in the allowable range. When the detected development density data does not coincide with the input density data in the allowable range, the program advances to step 1009. In step 1009, the output level of the laser power supply circuit 70 to the laser beam scanner 16 is corrected when the output control value given to the output control circuit 72 is changed by a predetermined value. For example, when the input density data inputted by the density setting input key means 90 is a density value 75%, and when the detected development density data is lower than the input density data, the output control value given to the output control circuit 72 is increased by a predetermined value so that the laser beam scanner 16 can be operated by the electric power higher than 1.0 mW. On the other hand, when the detected development density data is higher than the input density data, the output control value given to the output control circuit 72 is lowered by a predetermined value so that the laser beam scanner 16 can be operated by the electric power lower than 1.0 mW.

After that, the program is returned to step 1004, and the same operation is repeated. The repetition is continued until the detection development density data coincides with the input density data in the allowable range in step 1008. At this time, the output control value to the output control circuit 72, which is stored in RAM 58*c*, is rewritten and renewed at any time, and the last renewed value is employed as an input density data correction value for the output control value to the output control circuit 72.

In step 1008, when the detected development density data coincides with the input density data in the allowable range, the program advances to step 1010. In step 1010, it is judged whether or not a recording command has been given in a predetermined period of time. When a recording command has been given in a predetermined period of time, a recording operation routine (not shown) is carried out, and the actual multicolor recording is started. In this case, when the electrostatic latent image is written in each of the electrostatic recording units Y, C, M and B, the output level given to the laser beam scanner 16 by the laser power circuit 70 is determined in accordance with the input density data correction value stored in RAM 58*c*. Due to the foregoing, it can be guaranteed that the amount of deposited toner of each color in the multicolor recording, that is, the development density is provided with an appropriate hue. On the other hand, when a recording command is not given in a predetermined period of time, the main motor 60 is temporarily stopped, and the high speed laser printer is put in a waiting condition with respect to the multicolor recording operation.

In the development density correction routine shown in FIG. 10, the density data inputted by the density setting input key means 90 may be replaced with the amount of deposited toner. In this case, the graph shown in FIG. 4 is held in the primary control circuit 58 as a ROM table, and an output value of the OD sensor 30 is inputted into the ROM table so that it is converted into an amount of deposited toner, and the converted toner deposition amount is compared with the input toner deposition amount inputted by the density setting input key means 90.

Figure 11:
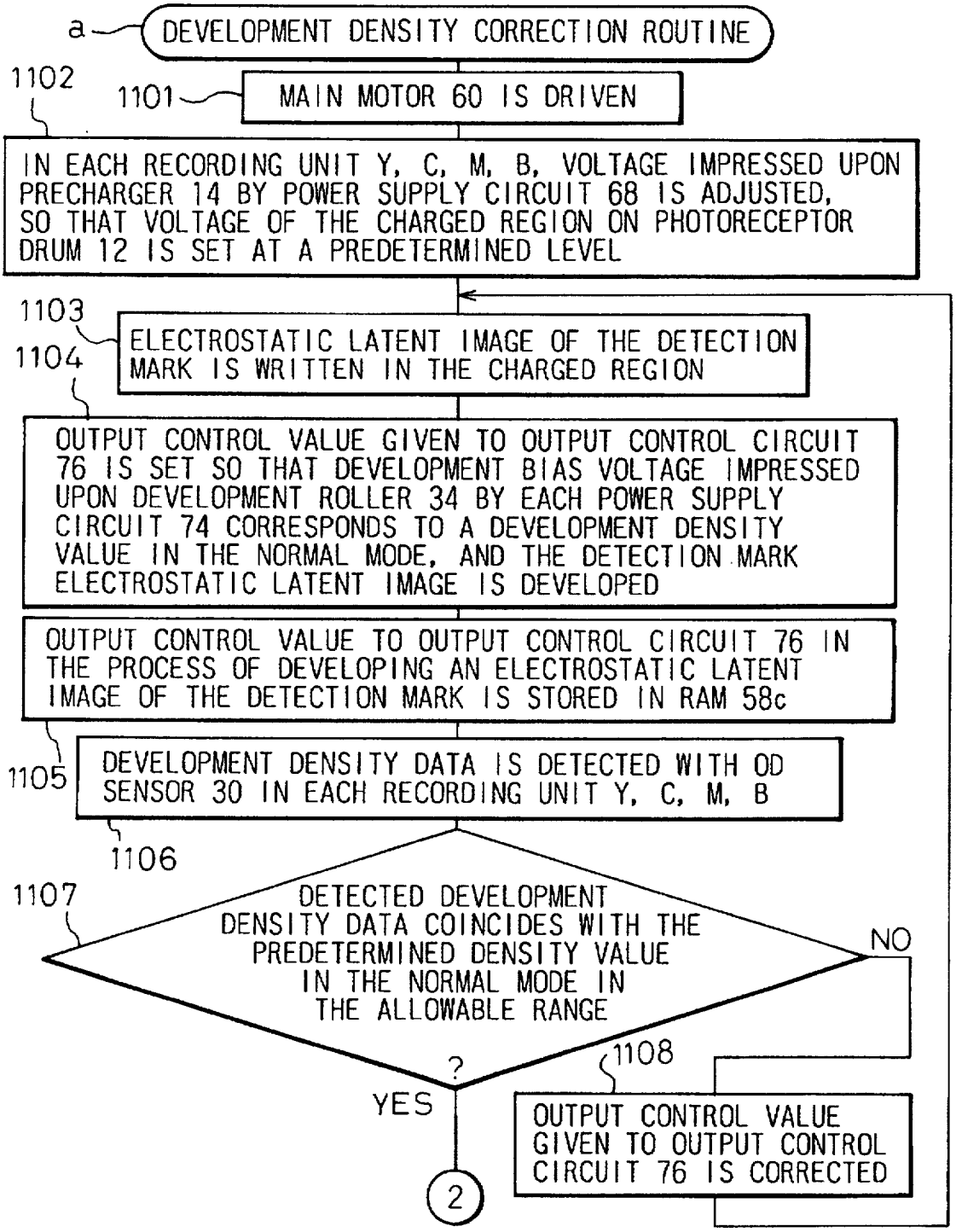
FIGS. 11 and 12 are a series of flow charts showing a development density correction routine to correct a setting density value in the normal and economical modes, wherein a development bias voltage to the development roller is used as a control parameter.
Figure 12:
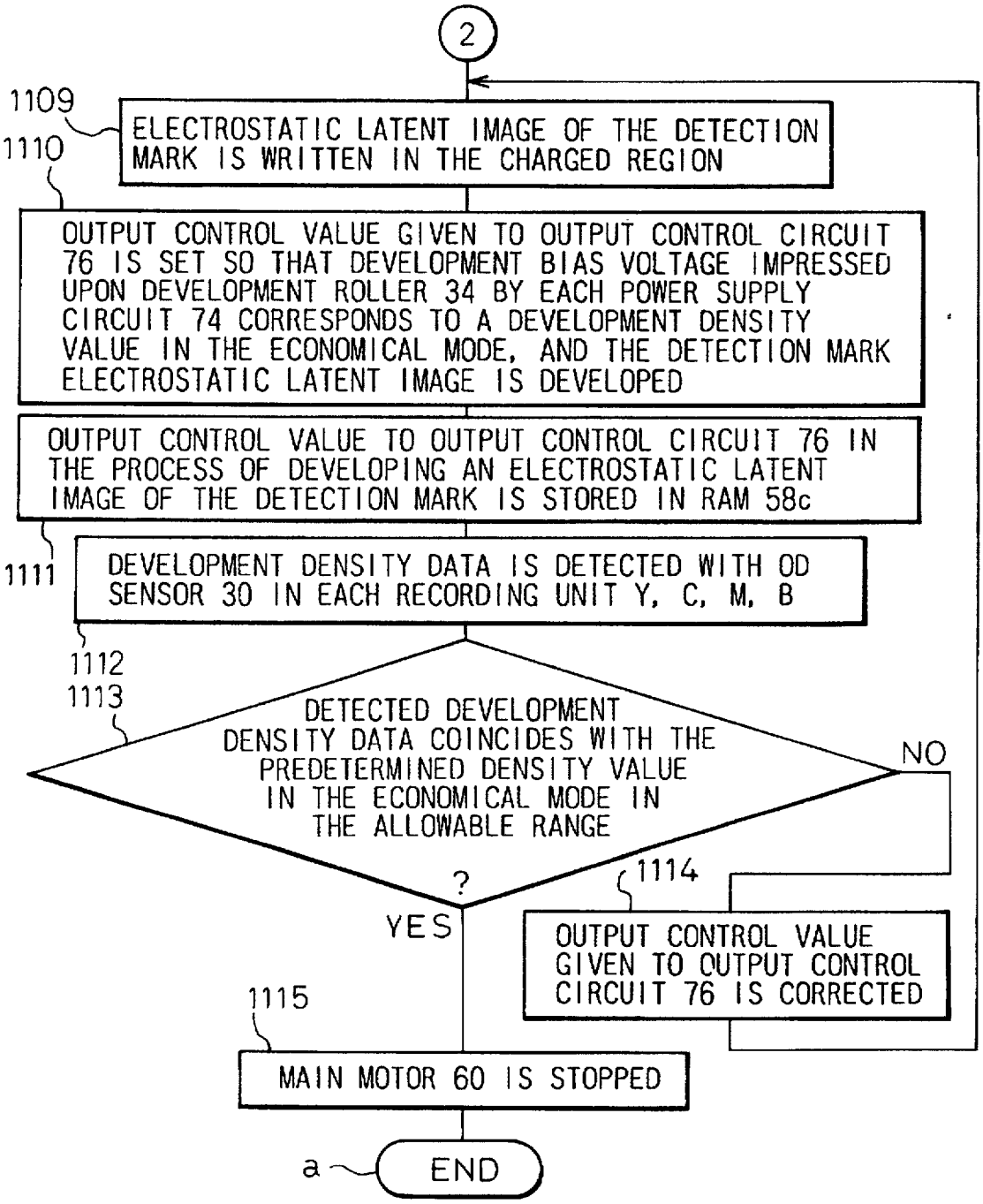

As can be seen from the above descriptions, in the development density correction routine shown in FIGS. 7 and 8, and also in the development density correction routine shown in FIG. 10, the output level given to the laser beam scanner 16 by the laser power supply circuit 70 is used as a control parameter for correcting the development density. However, it is possible to use other control parameters for correcting the development density. In FIGS. 11 and 12, there is shown a development density correction routine in which a development bias voltage impressed upon the development roller 34 by the bias power supply 76 is used as a control parameter. Multicolor recording in which the hue is maintained constant at all times can be also accomplished by this development density correction routine. In this connection, the development density correction routine shown in FIGS. 11 and 12 is also carried out when the power switch 84 is turned on.

In step 1101, in order to drive the main motor 60, the primary control circuit 58 outputs an ON signal into the power supply circuit 62 through the I/O 58*d*. Due to the foregoing, the photoreceptor drum 12 is rotationally driven, and at the same time the developing unit 18 is operated. Next, in step 1102, in each of the electrostatic recording units Y, C, M and B, a voltage impressed upon the precharger 14 by the power supply circuit 66 is adjusted when the output control value given to the output control circuit 68 by the primary control circuit 58 is controlled. In this way, an electric potential in the charged region on the photoreceptor drum 12 is maintained at a predetermined value. That is, the electric potential in the charged region on the photoreceptor drum 12 is detected by the electric potential sensor 80. The detected data is taken into the primary control circuit 58 through the A/D converter 82. When this electric potential data is compared with a predetermined setting value and the output control value to the output control circuit 68 is subjected to feedback control, the electric potential in the charged region on the photoreceptor drum 12 can be maintained, for example, at −600 V. In this way, even if the characteristic of the photoreceptor drum 12 is deteriorated with time, the predetermined electric potential can be guaranteed in the charged region on the photoreceptor drum 12.

In step 1103, in each of the electrostatic recording units Y, C, M and B, the electrostatic latent image of the detection mark is written in the charged region on the photoreceptor drum 12 by the laser beam LB sent from the laser beam scanner 16. At this time, an output control value given to the output control circuit 72 by the primary control circuit 58 is determined so that the laser beam scanner 16 can be operated by the laser power supply circuit 70 at the electric power of 1.5 mW.

In step 1104, the electrostatic latent image of the detection mark is developed by the toner component of each color in each developing unit 18. At this time, an output control value given to the output control circuit 76 by the primary control circuit 58 is determined so that the development bias voltage impressed upon the development roller 34 by the bias power supply circuit 74 corresponds to a predetermined density value in the normal mode. That is, when the primary control circuit 58 outputs a control signal to the output control circuit 76 in accordance with the output control value that has been set in the above manner, the development bias voltage impressed upon the development roller 34 by the bias power supply circuit 74 becomes a value corresponding to the predetermined density value. For example, under the condition that the electric potential in the charged region on the photoreceptor drum 12 is −600 V and the operational electric power given to the laser beam scanner 16 is 1.5 mW, the output control value sent to the output control circuit 76 is determined so that the development bias voltage impressed upon the development roller 34 by the bias power supply circuit 74 can be −400 V. Between the development bias voltage and the development density, there is a relationship shown in FIG. 13. In this embodiment, the development density provided when the development bias voltage of −400 V is impressed upon the development roller 34 is defined to be a density value of 100% in the normal mode. However, even when the development bias voltage of −400 V is impressed upon the development roller 34, the development density of 100% is not necessarily provided. The reason is that an amount of deposited toner corresponding to the development density value 100% can not be necessarily obtained due to the fluctuation of electric charge of toner of each color as described before. In any case, in step 1104, when the development bias voltage −400 V is impressed upon the development roller 34, the electrostatic latent image of the detection mark is developed.

In step 1105, the output control value given to the output control circuit 76 in the development process of the electrostatic latent image of the detection mark is stored in RAM 58*c*. Next, in step 1106, an optical density value of the development detection mark is detected by the OD sensor 30. The optical density value is taken into the primary control circuit 58 through the A/D converter 78 as the development density data which represents an amount of deposited toner. Next, in step 1107, the detection development density data is compared with a predetermined density value corresponding to the amount of deposited toner of each of the electrostatic recording units Y, C, M, B in the normal mode. In this case, the amount of deposited toner of each electrostatic recording unit is described as follows. In the electrostatic recording unit Y, the predetermined amount of deposited toner is 4.2±0.4 g/m$^2$. In the electrostatic recording unit C, the predetermined amount of deposited toner is 5.2±0.4 g/m$^2$. In the electrostatic recording unit M, the predetermined amount of deposited toner is 4.7±0.4 g/m$^2$. In the electrostatic recording unit B, the predetermined amount of deposited toner is 5.0±0.4 g/m$^2$. Then it is judged whether or not the detection development density data coincides with the predetermined density value in the allowable range. When the detection development density data does not coincide with the predetermined density value in the allowable range in the normal mode, the program advances to step 1108. In step 1108, the development bias voltage impressed upon the development roller 34 by the bias power supply circuit 74 is corrected when the output control value given to the output control circuit 76 by the primary control circuit 58 is changed by a predetermined value. For example, when the detection development density data is lower than the predetermined density value in the normal mode, the output control value given to the output control circuit 76 is increased by a predetermined value so that an absolute value of the development bias voltage −400 V impressed upon the development roller 34 can be increased. When the detection development density data is higher than the predetermined density value in the normal mode, the output control value given to the output control circuit 76 is decreased by a predetermined value so that an absolute value of the development bias voltage −400 V impressed upon the development roller 34 can be decreased. In this connection, the predetermined density value in the normal mode is previously stored in ROM 58*b* as a constant.

After that, the program is returned to step 1103, and the same operation is repeated. The repetition is continued until the detection development density data coincides with the predetermined density value in the allowable range in the normal mode in step 1107. At this time, the output control value to the output control circuit 76, which is stored in RAM 58*c*, is rewritten and renewed at any time, and the last renewed value is employed as a normal mode correction value for the output control value to the output control circuit 76.

When the detected development density data coincides with the predetermined density value of the normal mode in the allowable range in step 1107, the program advances to step 1109. In step 1109, the electrostatic latent image of the detection mark is written in the charged region on the photoreceptor drum 12 by the laser beam LB. At this time, the output control value given to the output control circuit 72 is determined so that the laser beam scanner 16 can be operated by the laser power supply circuit 70 by the electric power of 1.5 mW.

Figure 13:
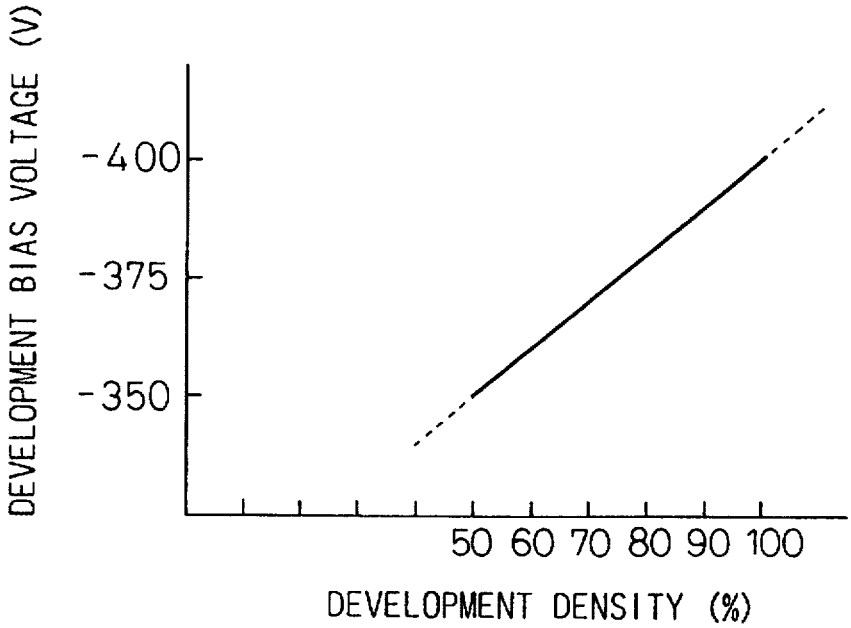
FIG. 13 is a graph showing the relationship between the development density and the development bias voltage impressed upon the development roller.

In step 1110, the electrostatic latent image of the detection mark is developed by each developing unit 18 with toner of each color. In this case, the output control value given to the output control circuit 76 by the primary control circuit 58 is determined in such a manner that the development bias voltage impressed upon the development roller 34 by the bias power supply circuit 74 corresponds to the predetermined density value in the economical mode. In this embodiment, the predetermined density value in the economical mode is a half of the density value in the normal mode. In other words, under the above condition, the output control value given to the output control circuit 76 by the primary control circuit 58 is set so that the development bias voltage impressed upon the development roller 34 by the bias power supply circuit 74 can be −350 V. As shown in the graph of FIG. 13, when the development bias voltage of −350 V is impressed upon the development roller 34, it is possible to provide an amount of deposited toner, the value of which corresponds to the development density value 50% that is a half of the development density value 100% in the normal mode. However, as described before, due to the fluctuation of the electric charge of toner of each color, it is not always possible to provide an amount of deposited toner that corresponds to the development density value in the economical mode. In any case, when the development bias voltage of −350 V is impressed upon the development roller 34 in step 1110, the electrostatic latent image of the detection mark is developed.

In step 1111, the output control value given to the output control circuit 76 in the development process of the electrostatic latent image of the detection mark is stored in RAM 58*c*. Next, in step 1112, an optical density value of the development detection mark is detected by the OD sensor 30. The optical density value is taken into the primary control circuit 58 through the A/D converter 78 as the development density data which represents an amount of deposited toner. Next, in step 1113, the detection development density data is compared with a predetermined density value corresponding to the amount of deposited toner of each of the electrostatic recording units Y, C, M, B in the economical mode. In this case, the amount of deposited toner of each electrostatic recording unit is described as follows. In the electrostatic recording unit Y, the predetermined amount of deposited toner is 3.6±0.4 g/m$^2$. In the electrostatic recording unit C, the predetermined amount of deposited toner is 4.5±0.04 g/m$^2$. In the electrostatic recording unit M, the predetermined amount of deposited toner is 4.0±0.04 g/m$^2$. In the electrostatic recording unit B, the predetermined amount of deposited toner is 3.0±0.04 g/m$^2$. Then it is judged whether or not the detection development density data coincides with the predetermined density value in the allowable range. When the detection development density data does not coincide with the predetermined density value in the allowable range in the economical mode, the program advances to step 1114. In step 1114, the development bias voltage impressed upon the development roller 34 by the bias power supply circuit 74 is corrected when the output control value given to the output control circuit 76 by the primary control circuit 58 is changed by a predetermined value. For example, when the detection development density data is lower than the predetermined density value in the normal mode, the output control value given to the output control circuit 76 is increased by a predetermined value so that an absolute value of the development bias voltage −350 V impressed upon the development roller 34 can be increased. When the detection development density data is higher than the predetermined density value in the normal mode, the output control value given to the output control circuit 76 is decreased by a predetermined value so that an absolute value of the development bias voltage −350 V impressed upon the development roller 34 can be decreased. In this connection, the predetermined density value in the economical mode is previously stored in ROM 58*b* as a constant.

After that, the program is returned to step 1109, and the same operation is repeated. The repetition is continued until the detection development density data coincides with the predetermined density value in the allowable range in the economical mode in step 1113. At this time, the output control value to the output control circuit 76, which is stored in RAM 58*c*, is rewritten and renewed at any time, and the last renewed value is employed as an economical mode correction value for the output control value to the output control circuit 76. Next, the program advances to step 1115, and the main motor is temporarily stopped here. At this time, the high speed laser printer is ready for the actual multicolor recording operation.

When the mode selection switch 88 is turned off, the multicolor recording is carried out in the normal mode. In this case, when the electrostatic latent image is developed by each of the electrostatic recording units Y, C, M and B, the development bias voltage impressed upon the development roller 34 by the bias power supply circuit 74 is determined in accordance with the normal mode correction value stored in RAM 58*c*. Due to the foregoing, the amount of deposited toner of each color, that is, the development density is guaranteed in the normal mode of multicolor recording so that the hue can be appropriately maintained. On the other hand, when the mode selection switch 88 is turned on, the multicolor recording is carried out in the economical mode. In this case, when the electrostatic latent image is developed by each of the electrostatic recording units Y, C, M and B, the development bias voltage impressed upon the development roller 34 by the bias power supply circuit 74 is determined in accordance with the economical mode correction value stored in RAM 58*c*. Due to the foregoing, the amount of deposited toner of each color, that is, the development density, is guaranteed in the normal mode of multicolor recording so that the hue can be appropriately maintained.

In the development density correction routine shown in FIGS. 11 and 12, the predetermined density values in the normal and economical modes may be set as the predetermined amounts of deposited toner. In this case, the graph shown in FIG. 4 is held in the primary control circuit 58 as a ROM table. An output value of the OD sensor 30 is inputted onto the ROM table and converted into a toner deposition amount. The thus converted toner deposition amount is compared with the predetermined toner deposition amount.

The development density correction routine shown in FIGS. 11 and 12 is carried out when the operation of the high speed printer starts, that is, when the power supply switch 84 is turned on. However, when an operator turns on the development density correction switch 86, the routine may be appropriately carried out. When the recording operation is not carried out by the high speed laser printer over a predetermined period of time under the condition that the power supply switch 84 of the high speed laser printer is turned on, for example, when the recording operation is not carried out over one hour, the development density routine shown in FIGS. 11 and 12 may be automatically carried out.

Figure 14A:
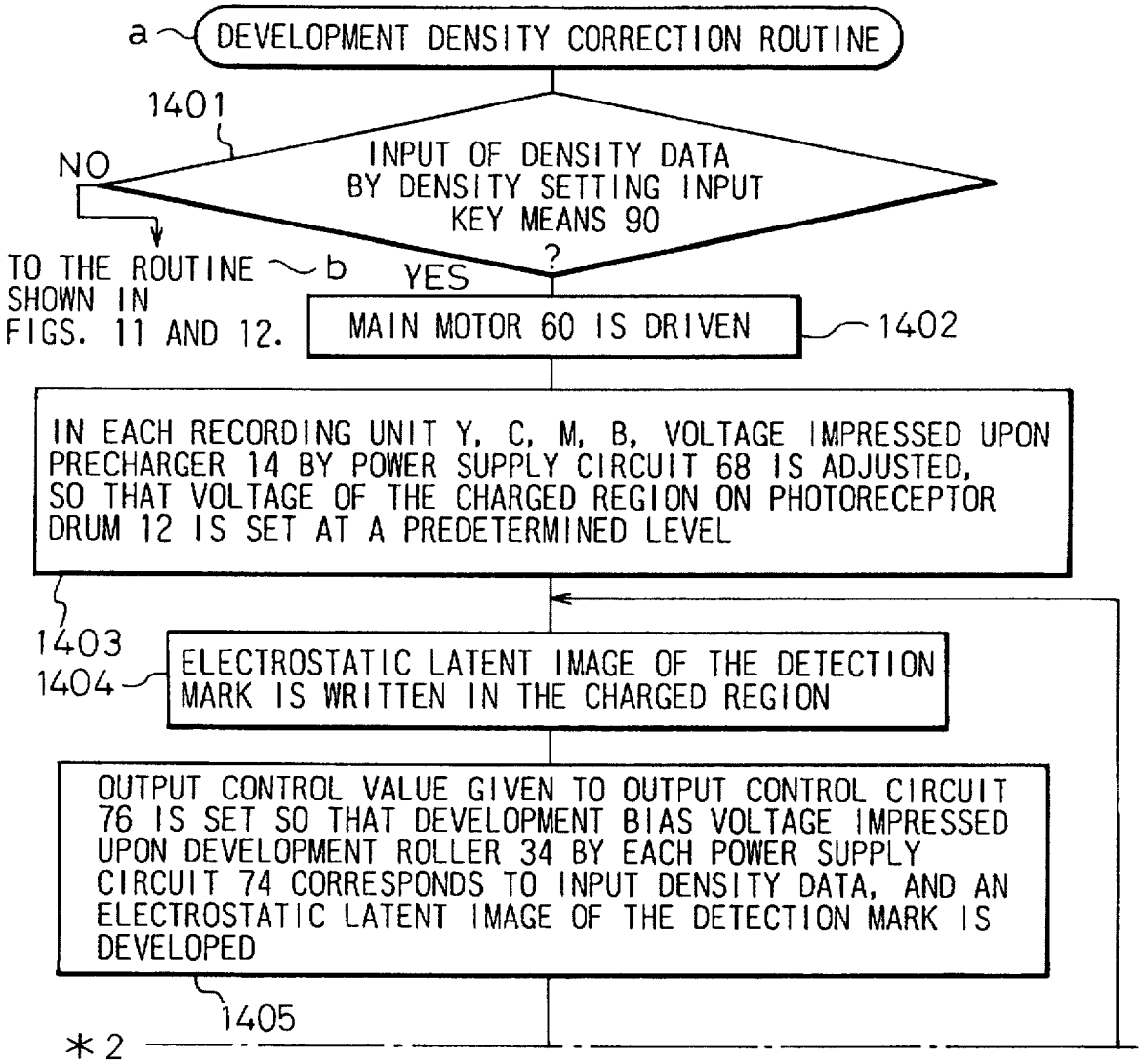
FIG. 14((*a*) and (*b*)) is a flow chart showing a development density correction routine to correct an arbitrary input setting density value, wherein a development bias voltage impressed upon the development roller is used as a control parameter.
Figure 14B:
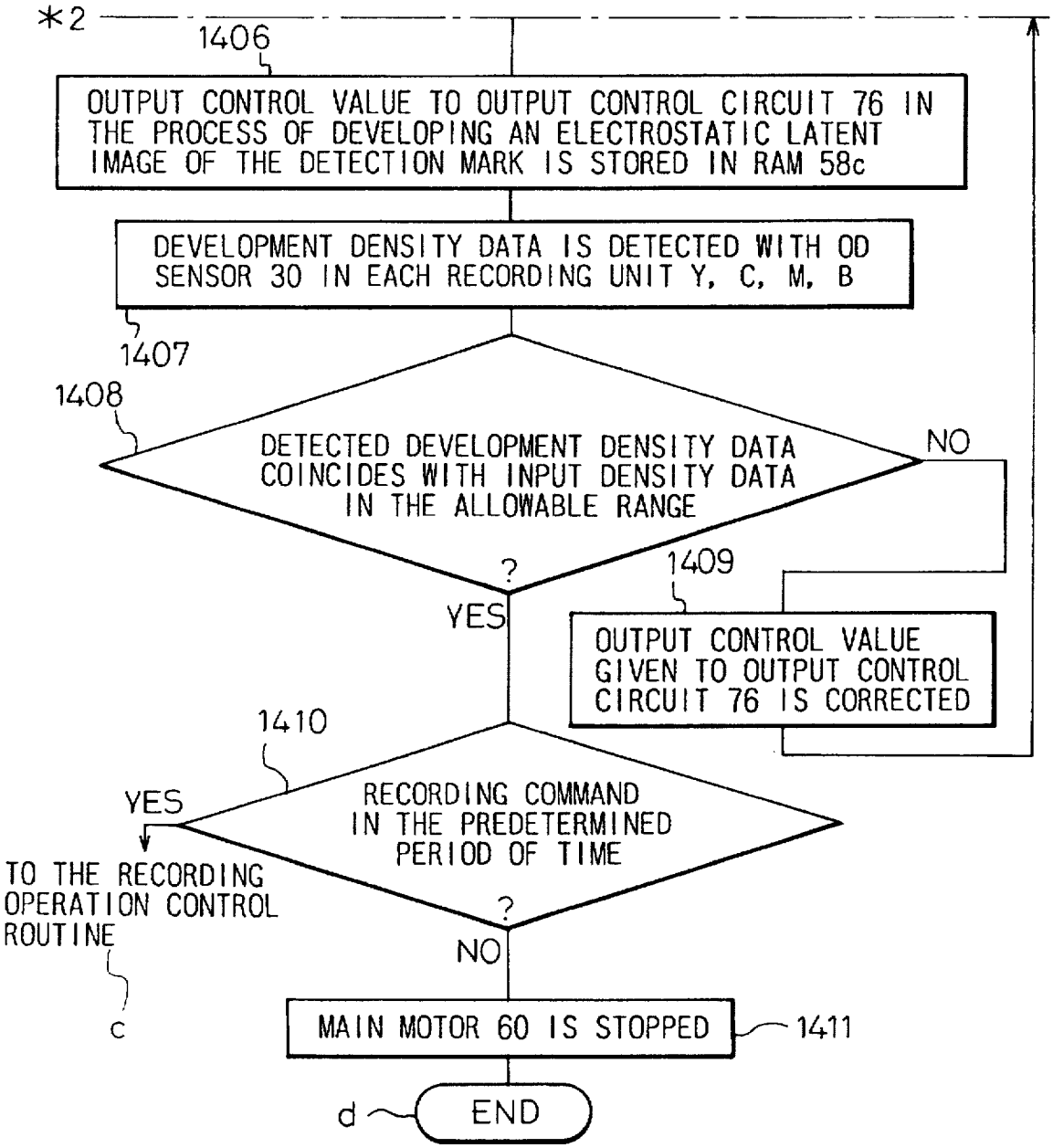

In the development density correction routine shown in FIGS. 11 and 12, the development density correction of multicolor recording is conducted only in the two cases of the normal and economical modes. However, in the same manner as the development density correction routine shown in FIG. 10, even when arbitrary density data is inputted by the density setting input key means 90, it is possible to correct the development density with respect to the arbitrary input density data. With reference to the development density correction routine shown in FIG. 14, the development density correction to correct the arbitrary input density data will be explained as follows. In this connection, the development density correction routine shown in FIG. 14 is carried out when the development density correction switch 86 is turned on after the arbitrary density data has been inputted using the density setting input key means 90.

In step 1401, it is judged whether or not the density data has been inputted by the density setting input key means 90. After the density data has been inputted, the program advances to step 1402. In step 1402, in order to drive the main motor 60, the primary control circuit 58 outputs an ON signal to the power supply circuit 62 through the I/O 58*d*. Due to the foregoing, the photoreceptor drum 12 is rotated and the developing unit 18 is operated at the same time. In this connection, when the image density data has not been inputted by the density setting input key means 90, the development density correction routine shown in FIGS. 11 and 12 is carried out by switching ON the development density correction switch 86. Next, in step 1403, in each of the electrostatic recording units Y, C, M and B, a voltage impressed upon the precharger 14 by the power supply circuit 66 is adjusted by the output control circuit 68. In this way, an electric potential in the charged region on the photoreceptor drum 12 can be maintained at −600 V.

In step 1404, in each of the electrostatic recording units Y, C, M and B, the electrostatic latent image of the detection mark is written in the charged region on the photoreceptor drum 12 by the laser beam LB sent from the laser beam scanner 16. At this time, the output control value given to the output control circuit by the primary control circuit 58 is determined so that the laser beam scanner 16 can be operated by the laser power supply circuit 70 with the electric power of 1.5 mW.

In step 1405, the electrostatic latent image of the detection mark is developed by the toner component of each color in each developing unit 18. At this time, an output control value given to the output control circuit 76 by the primary control circuit 58 is determined so that the development bias voltage impressed upon the development roller 34 by the bias power supply circuit 74 corresponds to the input density data. That is, when the primary control circuit 58 outputs a control signal to the output control circuit 76 in accordance with the output control value that has been set in the above manner, the development bias voltage impressed upon the development roller 34 by the bias power supply circuit 74 becomes a value corresponding to the input density data. For example, when the input density data inputted by the density setting input key means 90 is determined to be a density value of 75% with respect to the development density 100% in the normal mode, as can be seen from FIG. 13, the output control value given to the output control circuit 76 is determined so that a development bias voltage of 375 V can be impressed upon the development roller 34. At this time, it is possible to provide an amount of deposited toner corresponding to the development density 75% with respect to the development density in the normal mode. However, from the reasons described before, it is not always possible to provide an amount of deposited toner corresponding to the development density 75%. In any case, when the development bias voltage corresponding to the input density data is impressed upon the development roller 34 in step 1405, the electrostatic latent image of the detection mark is developed.

In step 1406, the output control value given to the output control circuit 76 at the time of developing the electrostatic latent image of the detection mark is stored in RAM 58*c*. Next, in step 1407, the optical density value of the development detection mark is detected by the OD sensor 30, and the detected optical density value is taken into the primary control circuit 58 through the A/D converter 78 as the development density data of the detection mark which represents an amount of deposited toner. Next, in step 1408, the detected development density data is compared with the input density data, and it is judged whether or not the detected development density data coincides with the input density data in the allowable range. When the detected development density data does not coincide with the input density data in the allowable range, the program advances to step 1409. In step 1409, the development bias voltage impressed upon the development roller 34 by the bias power supply circuit 74 is corrected when the output control value given to the output control circuit 76 is changed by a predetermined value. For example, in the case where the input density data is a density value of 75%, when the detected development density data is lower than the input density data, the output control value given to the output control circuit 76 by the primary control circuit 58 is increased by a predetermined value so that the development bias voltage −350 V impressed upon the development roller 34 can be increased. When the detected development density data is higher than the input density data, the output control value given to the output control circuit 76 by the primary control circuit 58 is decreased by a predetermined value so that the development bias voltage −350 V impressed upon the development roller 34 can be decreased.

After that, the program is returned to step 1404, and the same operation is repeated. The repetition is continued until the detected development density data coincides with the input density data in the allowable range in step 1408. At this time, the output control value to the output control circuit 76, which is stored in RAM 58*c*, is rewritten and renewed at any time, and the last renewed value is employed as a correction value of the input density data for the output control value given to the output control circuit 76.

When the detected development density data coincides with the input density data in step 1408, the program advances to step 1410. In step 1410, it is judged whether or not a recording command has been given in a predetermined period of time. When a recording command has been given in a predetermined period of time, a recording operation routine (not shown) is carried out, and the actual multicolor recording is started. In this case, when the electrostatic latent image is written in each of the electrostatic recording units Y, C, M and B, the development bias voltage impressed upon the development roller 34 by the bias power supply circuit 74 is determined in accordance with the input density data correction value stored in RAM 58*c*. Due to the foregoing, it can be guaranteed that the amount of deposited toner of each color in the multicolor recording, that is, the development density is provided with an appropriate hue. On the other hand, when a recording command is not given in a predetermined period of time, the main motor is temporarily stopped, and the high speed laser printer is put in a waiting condition with respect to the multicolor recording operation.

In the development density correction routine shown in FIG. 14, the density data inputted by the density setting input key means 90 may be set as a predetermined amount of deposited toner. In this case, the graph shown in FIG. 4 is kept in the primary control circuit 58 as a ROM table. An output value of the OD sensor 30 is inputted onto the ROM table and converted into a toner deposition amount. The thus converted toner deposition amount is compared with the input toner deposition amount inputted by the density setting input key means 90.

Figure 15:
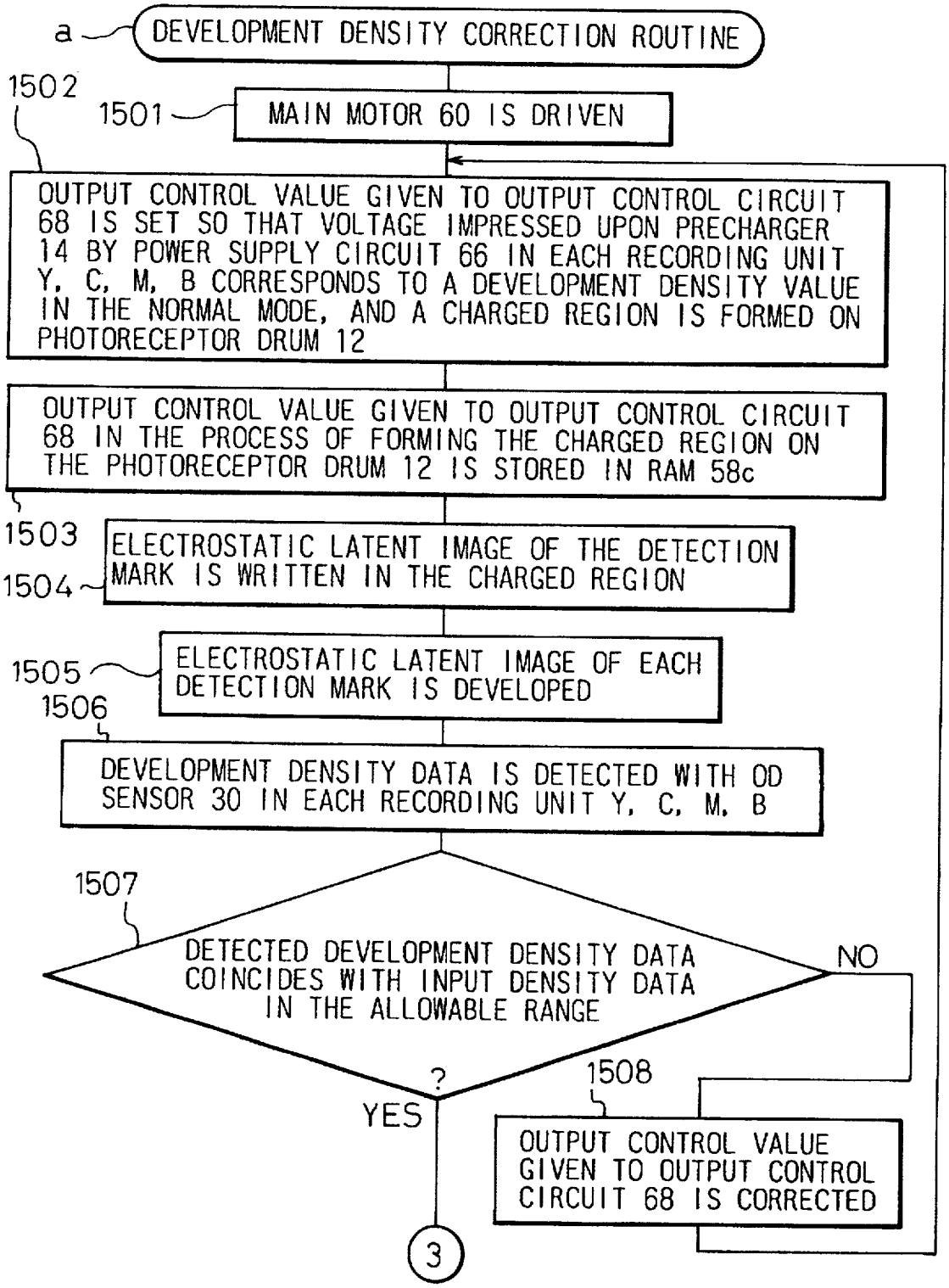
FIGS. 15 and 16 are a series of flow charts showing a development density correction routine to correct a setting density value in the normal and economical modes, wherein a voltage impressed upon the precharger is used as a control parameter.
Figure 16:
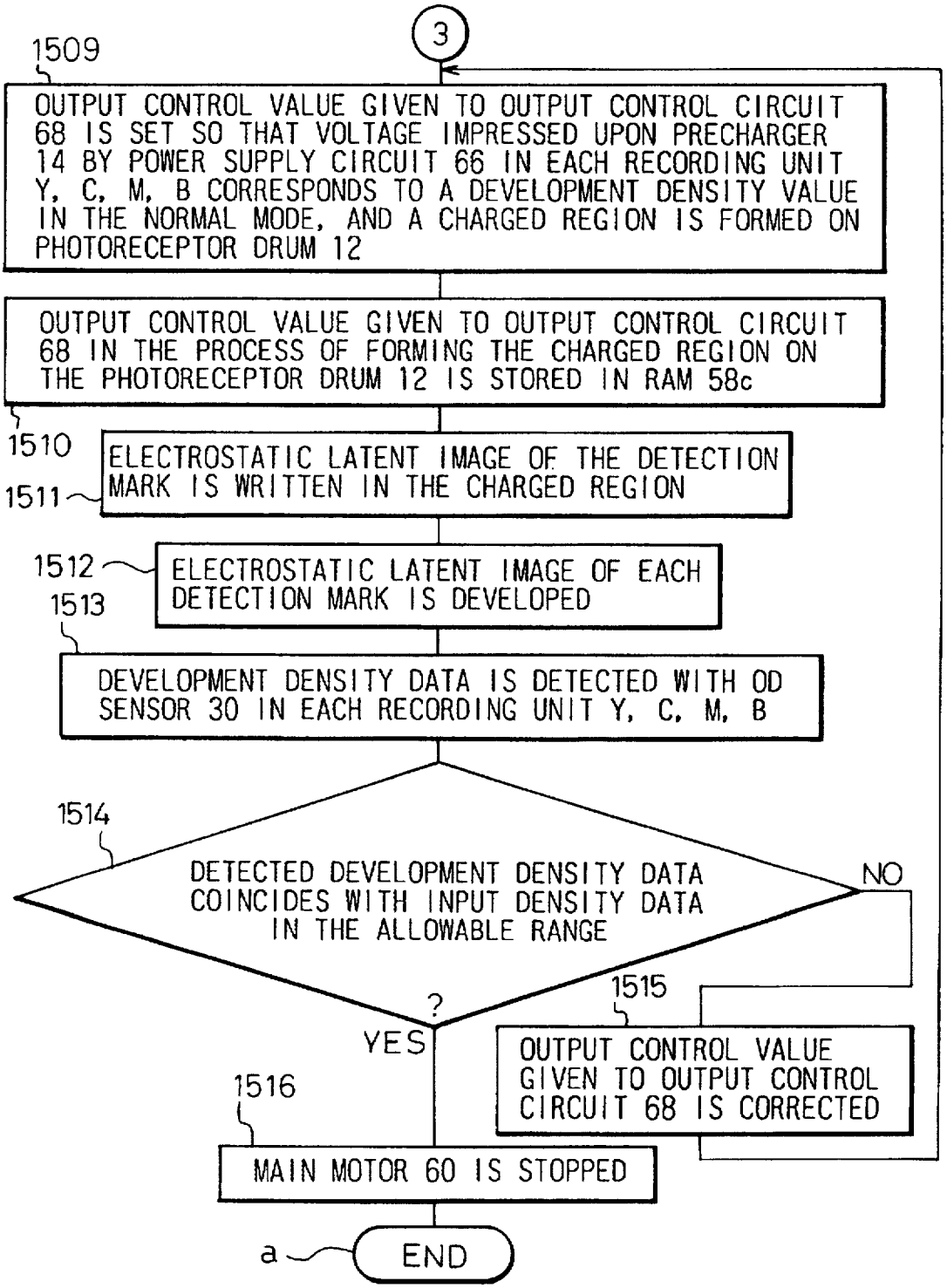

FIGS. 15 and 16 show another development density correction routine in which a voltage impressed upon the precharger 14 by the power supply circuit 66 is used as a parameter. By this development density correction routine, it is possible to guarantee the multicolor recording provided with a constant hue. In this connection, the development density correction routine shown in FIGS. 15 and 16 is also carried out when the power supply switch 84 is turned on.

In step 1501, ON signal to drive the main motor 60 is outputted from the primary control circuit 58 to the power supply circuit 62 through I/O 58*d*. Due to the ON signal, the photoreceptor drum 12 is rotated and the developing unit is operated. Next, in step 1502, in each of the electrostatic recording units Y, C, M and B, a voltage is impressed upon the precharger 14 by the power circuit 66. Due to the foregoing, a charged region is formed on the photoreceptor drum 12. An output control value given to the output control circuit 68 by the primary control circuit 58 is determined in such a manner that a voltage impressed upon the precharger 14 by the power supply circuit 66 corresponds to the predetermined density value in the normal mode. In other words, in accordance with the output control value determined in the above manner, the primary control circuit 58 outputs a control signal to the output control circuit 68, and then the voltage impressed upon the precharger 14 by the power circuit 66 becomes the predetermined density value in the normal mode. For example, under the condition that the operational electric power of the laser beam scanner 16 is 1.5 mW and the development bias voltage impressed upon the development roller 34 is −400 V, the output control value given to the output control circuit 68 by the primary control circuit 58 is determined so that the electric potential of the charged region on the photoreceptor drum 12 can be −600 V in accordance with the voltage impressed by the power supply circuit 66. There is a relation shown in FIG. 17 between the electric potential of the charged region on the photoreceptor drum 12 and the development density. In this embodiment, the development density obtained when the electric potential of the charged region on the photoreceptor drum 12 is −600 V is defined to be the density value 100% in the normal mode. However, even if the electric potential of the charged region on the photoreceptor drum 12 is kept to be −600 V, the development density value in the normal mode is not necessarily 100%. The reason is that an amount of deposited toner corresponding to the development density value 100% can not be necessarily obtained due to the fluctuation of electric charge of toner of each color. In any case, the charged region, the electric potential of which is −600 V, is formed on the photoreceptor drum 12 in step 1502.

In step 1503, the output control value given to the output control circuit 68 in the case of forming the charged region on each photoreceptor drum 12 is stored in RAM 58*c*. Next, in step 1504, the electrostatic latent image of the detection mark is written in the charged region on each photoreceptor drum 12 by the laser beam scanner 16. At this time, the operational electric power of the laser beam scanner 16 is 1.5 mW. Next, in step 1505, the electrostatic latent image of the detection mark is developed with toner components of each color. At this time, the development bias voltage impressed upon the development roller 34 is −400 V.

In step 1506, an optical density value of the development detection mark is detected by the OD sensor 30. The optical density value is taken into the primary control circuit 58 through the A/D converter 78 as the development density data which represents an amount of deposited toner. Next, in step 1507, the detection development density data is compared with a predetermined density value corresponding to the amount of deposited toner of each of the electrostatic recording units Y, C, M, B in the normal mode. In this case, the amount of deposited toner of each electrostatic recording unit is described as follows. In the electrostatic recording unit Y, the predetermined amount of deposited toner is 4.2±0.04 g/m$^2$. In the electrostatic recording unit C, the predetermined amount of deposited toner is 5.2±0.04 g/m$^2$. In the electrostatic recording unit M, the predetermined amount of deposited toner is 4.7±0.04 g/m$^2$. In the electrostatic recording unit B, the predetermined amount of deposited toner is 5.0±0.04 g/m$^2$. Then it is judged whether or not the detection development density data coincides with the predetermined density value in the allowable range. When the detection development density data does not coincide with the predetermined density value in the allowable range in the normal mode, the program advances to step 1508. In step 1508, the development bias voltage impressed upon the precharger 14 by the power supply circuit 66 is corrected when the output control value given to the output control circuit 68 is changed by a predetermined value. For example, when the detection development density data is lower than the predetermined density value in the normal mode, the output control value given to the output control circuit 76 is decreased by a predetermined value so that an absolute value −600 V of the electric potential of the charged region on the photoreceptor drum 12 can be decreased. When the detection development density data is higher than the predetermined density value in the normal mode, the output control value given to the output control circuit 76 is increased by a predetermined value so that the absolute value of −600 V of the electric potential of the charged region on the photoreceptor drum 12 can be increased. In this connection, the predetermined density value in the normal mode is previously stored in ROM 58*b* as a constant.

After that, the program is returned to step 1502, and the same operation is repeated. The repetition is continued until the detection development density data coincides with the predetermined density value in the allowable range in the normal mode in step 1507. At this time, the output control value to the output control circuit 68, which is stored in RAM 58*c*, is rewritten and renewed at any time, and the last renewed value is employed as a normal mode correction value for the output control value to the output control circuit 68.

Figure 17:
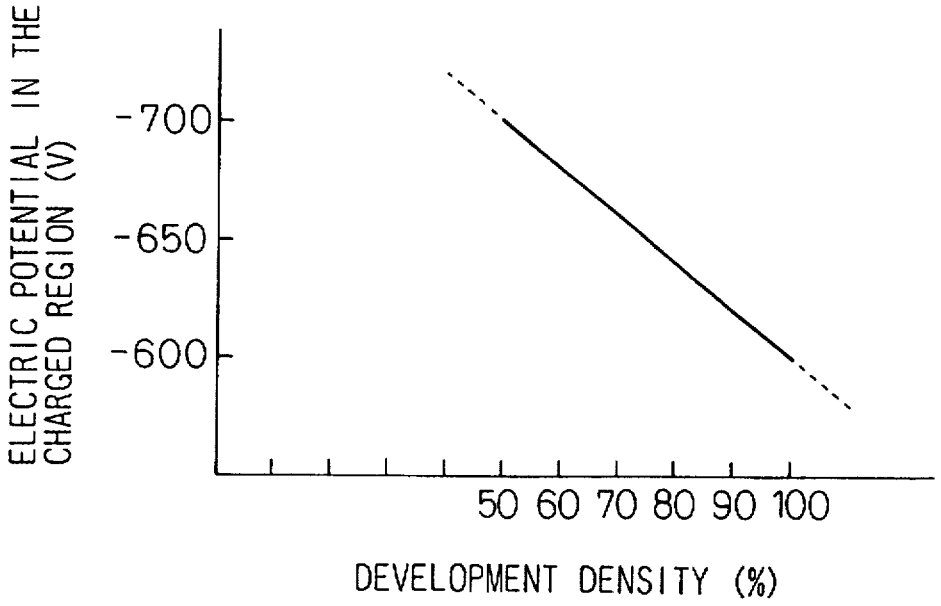
FIG. 17 is a graph showing the relationship between the development density and the electric potential in the charged region on the photoreceptor drum.

When the detected development density data coincides with the predetermined density value of the normal mode in the allowable range in step 1507, the program advances to step 1509. In step 1509, a voltage is impressed upon the precharger 14 by the power supply circuit 66 in each of the electrostatic recording units Y, C, M and B. Due to the foregoing, a charged region is formed on the photoreceptor drum 12. At this time, the output control value given to the output control circuit 68 is determined in such a manner that a voltage impressed upon the precharger 14 by the power supply circuit 66 corresponds to the predetermined density value in the economical mode. That is, under the above conditions, the output control value given to the output control circuit 68 is determined so that the electric potential of the charged region on the photoreceptor drum 12 can be −700 V in accordance with the voltage impressed by the power supply circuit 66. As shown in FIG. 17, when the electric potential of the charged region on the photoreceptor drum 12 is −700 V, it is possible to provide an amount of deposited toner, the value of which corresponds to the development density value 50% that is a half of the development density value 100% in the normal mode. However, as described before, due to the fluctuation of the electric charge of toner of each color, it is not always possible to provide an amount of deposited toner that corresponds to the development density value in the economical mode. In any case, in step 1509, an electrically charged region, the electric potential of which is −700 V, is formed on the photoreceptor drum 12.

In step 1510, the output control value given to the output control circuit 68 in the case of forming the charged region on each photoreceptor drum 12 is stored in RAM 58*c*. Next, in step 1511, the electrostatic latent image of the detection mark is written in the charged region on each photoreceptor drum 12 by the laser beam scanner 16. At this time, the operational electric power of the laser beam scanner 16 is 1.5 mW. Next, in step 1512, the electrostatic latent image of the detection mark is developed with toner components of each color. At this time, the development bias voltage impressed upon the development roller 34 is −400 V.

In step 1513, an optical density value of the development detection mark is detected by the OD sensor 30. The optical density value is taken into the primary control circuit 58 through the A/D converter 78 as the development density data which represents an amount of deposited toner. Next, in step 1514, the detection development density data is compared with a predetermined density value corresponding to the amount of deposited toner of each of the electrostatic recording units Y, C, M, B in the economical mode. In this case, the amount of deposited toner of each electrostatic recording unit is described as follows. In the electrostatic recording unit Y, the predetermined amount of deposited toner is 3.6±0.04 g/m$^2$. In the electrostatic recording unit C, the predetermined amount of deposited toner is 4.5±0.04 g/m$^2$. In the electrostatic recording unit M, the predetermined amount of deposited toner is 4.0±0.04 g/m$^2$. In the electrostatic recording unit B, the predetermined amount of deposited toner is 3.0±0.04 g/m$^2$. Then it is judged whether or not the detection development density data coincides with the predetermined density value in the allowable range. When the detection development density data does not coincide with the predetermined density value in the allowable range in the economical mode, the program advances to step 1515. In step 1515, the development bias voltage impressed upon the precharger 14 by the power supply circuit 66 is corrected when the output control value given to the output control circuit 68 is changed by a predetermined value. For example, when the detection development density data is lower than the predetermined density value in the economical mode, the output control value given to the output control circuit 76 is decreased by a predetermined value so that an absolute value −700 V of the electric potential of the charged region on the photoreceptor drum 12 can be decreased. When the detection development density data is higher than the predetermined density value in the economical mode, the output control value given to the output control circuit 76 is increased by a predetermined value so that an absolute value −700 V of the electric potential of the charged region on the photoreceptor drum 12 can be increased. In this connection, the predetermined density value in the economical mode is previously stored in ROM 58*b* as a constant.

After that, the program is returned to step 1509, and the same operation is repeated. The repetition is continued until the detection development density data coincides with the predetermined density value in the allowable range in the economical mode in step 1514. At this time, the output control value to the output control circuit 68, which is stored in RAM 58*c*, is rewritten and renewed at any time, and the last renewed value is employed as an economical mode correction value for the output control value to the output control circuit 68. Next, the program advances to step 1516. In step 1516, the main motor 60 is temporarily stopped. At this time, the high speed laser printer is prepared for the actual multicolor recording.

When the mode selection switch 88 is in a condition of OFF, multicolor recording is conducted in the normal mode. In this case, when a charged region is formed on the photoreceptor drum 12 in each of the electrostatic recording units Y, C, M and B, a voltage impressed upon the precharger 14 by the power supply circuit 66 is determined in accordance with the correction value in the normal mode stored in RAM 58*c*. Due to the foregoing, the amount of deposited toner of each color, that is, the development density is guaranteed in the normal mode of multicolor recording so that the hue can be appropriately maintained. On the other hand, when the mode selection switch 88 is in a condition of ON, multicolor recording is conducted in the economical mode. In this case, when a charged region is formed on the photoreceptor drum 12 in each of the electrostatic recording units Y, C, M and B, a voltage impressed upon the precharger 14 by the power supply circuit 66 is determined in accordance with the correction value in the economical mode stored in RAM 58*c*. Due to the foregoing, the amount of deposited toner of each color, that is, the development density is guaranteed in the economical mode of multicolor recording so that the hue can be appropriately maintained.

In the development density correction routine shown in FIGS. 15 and 16, the predetermined density value in the normal or economical mode may be set as a predetermined amount of deposited toner. In this case, the graph shown in FIG. 4 is maintained in the primary control circuit 58 as a ROM table. An output value of the OD sensor 30 is inputted onto the ROM table and converted into a toner deposition amount. The thus converted toner deposition amount is compared with the predetermined toner deposition amount.

The development density correction routine shown in FIGS. 15 and 16 is carried out when the operation of the high speed printer starts, that is, when the power supply switch 84 is turned on. However, when an operator turns on the development density correction switch 86, the routine may be appropriately carried out in the same manner described above. When the recording operation is not carried out by the high speed laser printer over a predetermined period of time under the condition that the power supply switch 84 of the high speed laser printer is turned on, for example, when the recording operation is not carried out over one hour, the development density correction routine shown in FIGS. 15 and 16 may be automatically carried out.

Figure 18A:
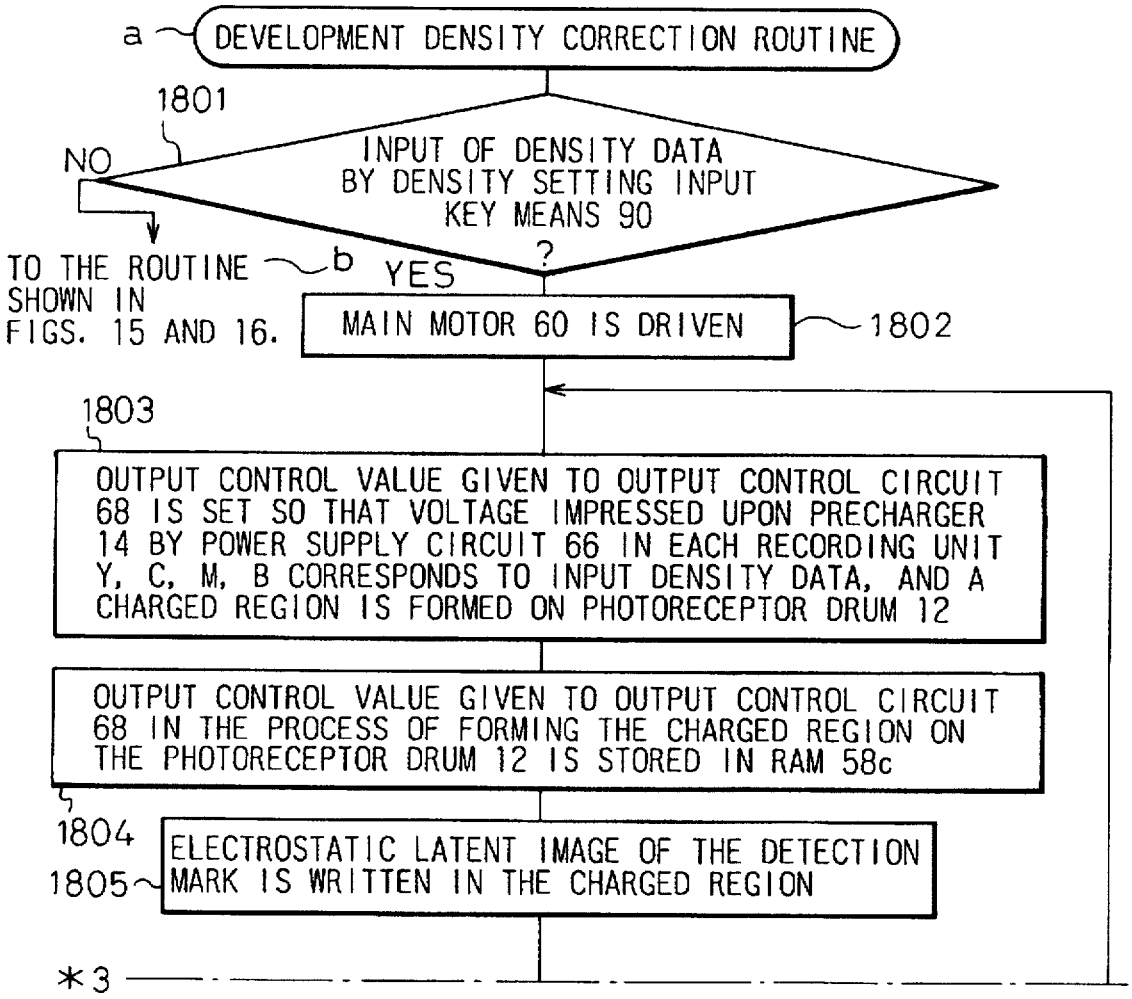
FIG. 18((*a*) and (*b*)) is a flow chart showing a development density correction routine for correcting an arbitrary input setting density value, wherein a voltage impressed upon the precharger is used as a control parameter.
Figure 18B:
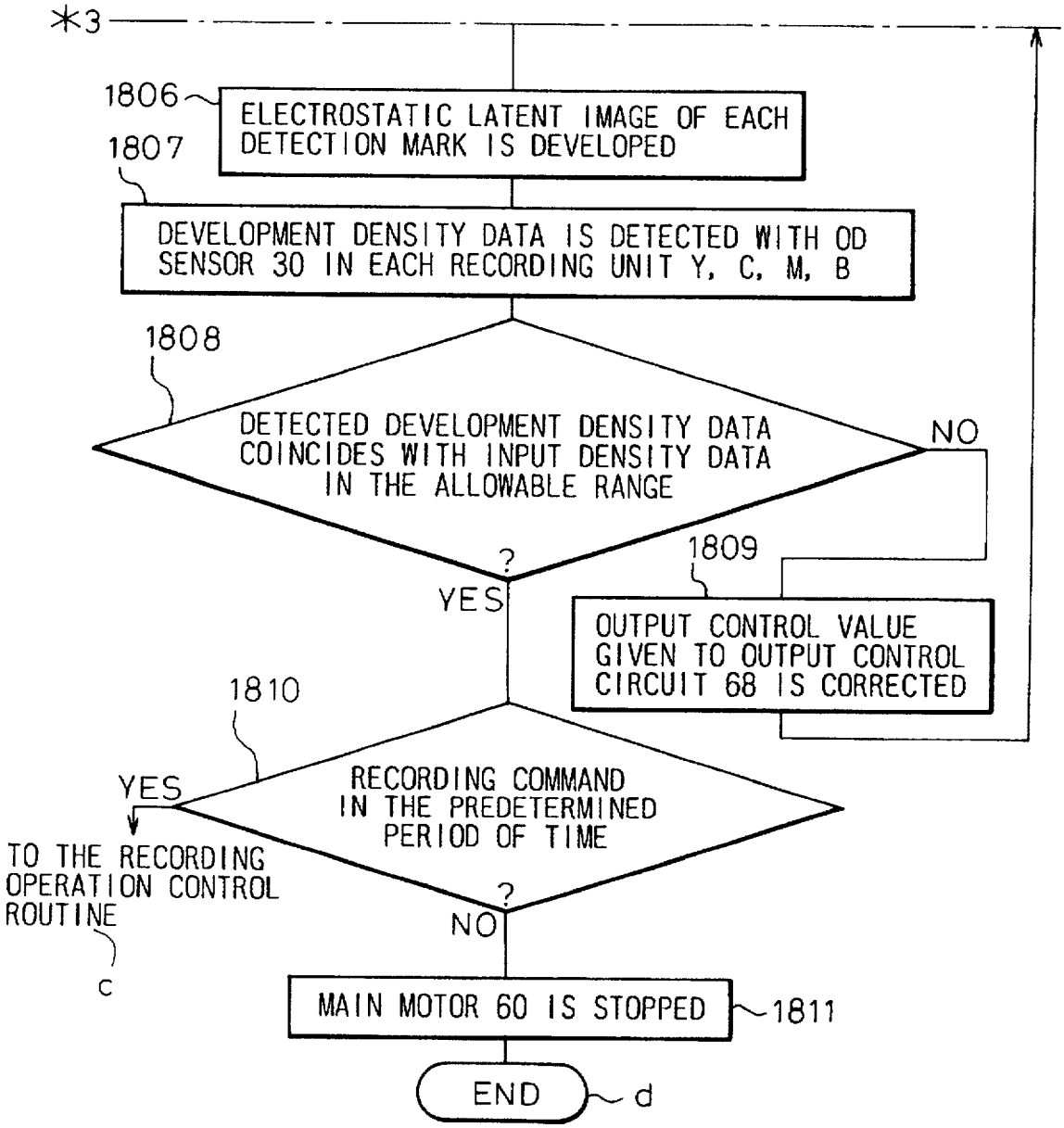
Figure 19A:
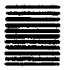
FIGS. 19(*a*) to 19(*e*) are schematic illustrations showing examples of the pattern of the detection mark.
Figure 19B:
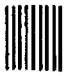
Figure 19C:
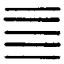
Figure 19D:
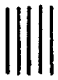
Figure 19E:
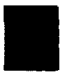

In the development density correction routine shown in FIGS. 15 and 16, the development density correction of multicolor recording is conducted only in the two cases of the normal and economical modes. However, in the same manner as that of the development density routine shown in FIGS. 10 and 14, even when arbitrary density data is inputted by the density setting input key means 90, it is possible to correct the development density with respect to the arbitrary input density data. With reference to the development density correction routine shown in FIG. 18, the development density correction to correct the arbitrary input density data will be explained as follows. In this connection, the development density correction routine shown in FIG. 18 is carried out when the development density correction switch 86 is turned on after the arbitrary density data has been inputted using the density setting input key means 90.

In step 1801, it is judged whether or not the density data has been inputted by the density setting input key means 90. After the density data has been inputted, the program advances to step 1802. In step 1802, in order to drive the main motor 60, the primary control circuit 58 outputs an ON signal to the power supply circuit 62 through the I/O 58*d*. Due to the foregoing, the photoreceptor drum 12 is rotated and the developing unit 18 is operated at the same time. In this connection, when the image density data has not been inputted by the density setting input key means 90, the development density correction routine shown in FIGS. 15 and 16 is carried out by switching ON the development density correction switch 86. In step 1803, in each of the electrostatic recording units Y, C, M and B, a voltage is impressed upon the precharger 14 by the power supply circuit 66. Due to the foregoing, a charged region is formed on the photoreceptor. At this time, an output control value given to the output control circuit 68 is determined so that the voltage impressed upon the precharger 14 by the power supply circuit 66 corresponds to the input density data. That is, when a control signal is outputted to the output control circuit 68 by the primary control circuit 58 in accordance with the output control value determined in the above manner, the voltage impressed upon the precharger 14 by the power circuit 66 becomes a value corresponding to the input density data. For example, when the input density data inputted by the density setting input key means 90 is a density value 75% with respect to the development density value 100% in the normal mode, the output control value given to the output control circuit 68 is set, as can be seen from the graph in FIG. 17, so that the electric potential of the charge region on the photoreceptor drum 12 can be −650 V in accordance with the voltage impressed by the power supply circuit 66. However, for the reasons described before, an amount of deposited toner corresponding to the development density value 75% can not be necessarily provided. In any case, in step 1803, when a voltage corresponding to the input density data is impressed upon the precharger 14 by the power supply circuit 66, a charged region is formed on the photoreceptor drum 12.

In step 1804, the output control value to the output control circuit 68 in the case of forming the charged region on the photoreceptor drum 12 is stored in RAM 58*c*. Next, in step 1805, the electrostatic latent image of the detection mark is written in the charged region on each photoreceptor drum 12 by the laser beam scanner 16. At this time, the operational electric power of the laser beam scanner 16 is 1.5 mW. Next, in step 1806, the electrostatic latent image of the detection mark is developed by the toner component of each color in each developing unit. At this time, the development bias voltage impressed upon the development roller 34 is −400 V.

In step 1807, an optical density value of the development detection mark is detected by the OD sensor 30. The detected optical density value is taken into the primary control circuit 58 through the A/D converter 78 as the development density data of the detection mark, wherein the development density data represents an amount of deposited toner. Next, in step 1808, the thus detected development density data is compared with the input density data, and it is judged whether or not the detected development density coincides with the input density data in the allowable range. When the detected development density data does not coincide with the input density data in the allowable range, the program advances to step 1809. In step 1809, the output level of the laser power supply circuit 66 to the precharger 14 is corrected when the output control value given to the output control circuit 68 is changed by a predetermined value. For example, when the input density data is a density value 75%, and when the detected development density data is lower than the input density data, the output control value given to the output control circuit 76 is decreased by a predetermined value so that an absolute value of the electric potential −650 V of the charged region on the photoreceptor drum 12 can be lowered. When the detected development density data is higher than the input density data, the output control value given to the output control circuit 76 is increased by a predetermined value so that an absolute value of the electric potential −650 V of the charged region on the photoreceptor drum 12 can be raised.

After that, the program is returned to step 1803, and the same operation is repeated. The repetition is continued until the detection development density data coincides with the input density data in the allowable range in step 1808. At this time, the output control value to the output control circuit 68, which is stored in RAM 58*c*, is rewritten and renewed at any time, and the last renewed value is employed as an input density data correction value for the output control value to the output control circuit 68.

In step 1808, when the detected development density data coincides with the input density data in the allowable range, the program advances to step 1010. In step 1010, it is judged whether or not a recording command has been given in a predetermined period of time. When a recording command has been given in a predetermined period of time, a recording operation routine (not shown) is carried out, and the actual multicolor recording is started. In this case, when the charged region is formed on the photoreceptor drum 12 in each of the electrostatic recording units Y, C, M and B, the voltage impressed upon the precharger 14 by the power supply circuit 66 is determined in accordance with the input density data correction value held in RAM 59*c*. Due to the foregoing, it can be guaranteed that the amount of deposited toner of each color in the multicolor recording, that is, the development density is provided with an appropriate hue. On the other hand, when a recording command is not given in a predetermined period of time, the main motor 60 is temporarily stopped, and the high speed laser printer is put in a waiting condition.

In the development density correction routine shown in FIG. 18, the density data inputted by the density setting input key means 90 may be replaced with the amount of deposited toner. In this case, the graph shown in FIG. 4 is held in the primary control circuit 58 as a ROM table, and an output value of the OD sensor 30 is inputted into the ROM table so that it is converted into an amount of deposited toner, and the converted toner deposition amount is compared with the input toner deposition amount inputted by the density setting input key means 90.

In the above embodiments, the output level to the laser beam scanner 16, the development bias voltage impressed upon the development roller 34, and the voltage impressed upon the precharger 14 are respectively individually adjusted so as to correct the development density. However, it is possible to correct the development density when at least two of theses parameters are combined. For example, when a predetermined development density correction can not be accomplished in a range of output level adjustment of the laser beam scanner 16, further the development bias voltage impressed upon the development roller 34 or the voltage impressed upon the precharger 14 may be combined so as to accomplish the predetermined development density correction. Also, in the above embodiments, a plurality of detection marks may be continuously formed, and an average of the plurality of pieces of detected data is used as the detection data to be compared with the predetermined density value. Due to the foregoing, it is possible to enhance the detection accuracy. Further, when a plurality of pieces of data are obtained, the maximum and minimum may be omitted, and an average of the detection data except for the maximum and minimum may used as the detection data. In this connection, in the above development density correction routine, when the detected development density data does not coincide with the predetermined density value in the allowable range even if the parameters are adjusted by a plurality of times, it is preferable that the occurrence of an error is displayed.

In FIGS. 19(*a*) to 19(*e*), there are shown patterns of the detection mark. The detection mark shown in FIG. 19(*a*) is formed to be a pattern in which lateral lines of one dot are arranged at regular intervals. The detection mark shown in FIG. 19(*b*) is formed to be a pattern in which longitudinal lines of one dot are arranged at regular intervals. The detection mark shown in FIG. 19(*c*) is formed to be a pattern in which lateral lines of two dots are arranged at regular intervals. The detection mark shown in FIG. 19(*d*) is formed to be a pattern in which longitudinal lines of two dots are arranged at regular intervals. The detection mark shown in FIG. 19(*e*) is formed to be a solid mark. Of course, the detection mark is not limited to the patterns illustrated in FIGS. 19(*a*) to 19(*e*), but other patterns may be adopted.

We claim:

1. A multicolor electrostatic recording apparatus comprising at least two electrostatic recording units for forming at least two different colors, respectively, and means for superimposing the at least two color toner images obtained by said respective units, each of said electrostatic recording units comprising:

an electrostatic latent image carrier;

a developing means for developing an electrostatic latent image formed on said carrier with a color toner;

a detecting means for detecting a density of the developed image on the basis of a single detecting mark which is formed on said carrier as a part of the latent image and developed by said developing means;

a first discriminating means for comparing said density data detected by said detecting means with a predetermined first value to discriminate whether said density data falls in a first allowable range;

a first control means for feed-back controlling at least one of the parameters for determining the density of the developed image so that said density becomes to be in said first allowable range, when said density falls out of said first allowable range;

a first memory means for memorizing said at least one parameter as a first compensating data for the density of the developed image, when said density falls within said first allowable range;

a second discriminating means for comparing said density data detected by said detecting means with a predetermined second value, different from said first value, to discriminate whether said density falls in a second allowable range;

a second control means for feed-back controlling said at least one parameter for determining the density of the developed image so that said density becomes to be in said second allowable range, when said density falls out of said second allowable range;

a second memory means for memorizing said at least one parameter as a second compensating data for the density of the developed image, when said density falls within said second allowable range; and a selecting means for selecting one of said first and second compensating data on the basis of which process using said parameter for determining the density of the developed image should be carried out.

2. An apparatus as set forth in claim 1, wherein said electrostatic latent image carrier comprises a photoreceptor and each of said electrostatic recording units comprising:

an electrifying means for forming an electrified area on said photo-receptor; and an optical writing means for optically writing a latent image on said electrified area of said photo-receptor.

3. An apparatus as set forth in claim 2, wherein said one of the parameters for determining the density of the developed image is an electrical energy which is to be exerted to said optical writing means.

4. An apparatus as set forth in claim 2, wherein said one of the parameters for determining the density of the developed image is an electrical energy which is to be exerted to said electrifying means.

5. An apparatus as set forth in claim 1, wherein said developing means comprises a developing roller for holding a developing agent to bring the same to said electrostatic latent image carrier and said one of parameters for determining the density of the developed image is a developing bias voltage which is to be exerted to said developing roller.

6. A multicolor electrostatic recording apparatus comprising at least two electrostatic recording units for forming at least two different colors, respectively, and means for superimposing the at least two color toner images obtained by said respective units, each of said electrostatic recording units comprising:

an electrostatic latent image carrier;

a developing means for developing an electrostatic latent image formed on said carrier with a color toner;

a detecting means for detecting the density of the developed image on the basis of a single detecting mark which is formed on said carrier as a part of the latent image and developed by said developing means;

a discriminating means for comparing said density data detected by said detecting means with an optional desired density value to discriminate whether said density data falls in an allowable range;

a control means for feed-back controlling at least one of the parameters for determining the density of the developed image so that said density becomes to be in said allowable range, when said density falls out of said allowable range;

a memory means for memorizing said at least one parameter as a compensating data for the density of the developed image, when said density falls in said allowable range; and means for conducting, with said compensating data, a process using said parameter when determining the density of the developed image should be carried out.

7. An apparatus as set forth in claim 6, wherein said electrostatic latent image carrier comprises a photoreceptor and each of said electrostatic recording units comprising:

an electrifying means for forming an electrified area on said photo-receptor; and an optical writing means for optically writing a latent image on said electrified area of said photo-receptor.

8. An apparatus as set forth in claim 7, wherein said one of the parameters for determining the density of the developed image is an electrical energy which is to be applied to said optical writing means.

9. An apparatus as set forth in claim 7, wherein said one of the parameters for determining the density of the developed image is an electrical energy which is to be applied to said electrifying means.

10. An apparatus as set forth in claim 6, wherein said developing means comprises a developing roller for holding a developing agent to bring the same to said electrostatic latent image carrier and said one of parameters for determining the density of the developed image is a developing bias voltage which is to be applied to said developing roller.

* * * * *